US009593916B2

(12) United States Patent
Bailey et al.

(10) Patent No.: US 9,593,916 B2
(45) **Date of Patent: *Mar. 14, 2017**

(54) HIGH HARDNESS, HIGH TOUGHNESS IRON-BASE ALLOYS AND METHODS FOR MAKING SAME

(71) Applicant: ATI Properties, Inc., Albany, OR (US)

(72) Inventors: Ronald E. Bailey, Pittsburgh, PA (US); Thomas R. Parayil, New Kensington, PA (US); Glenn J. Swiatek, Palos Heights, IL (US)

(73) Assignee: ATI Properties LLC, Albany, OR (US)

( * ) Notice: Subject to any disclaimer, the term of this patent is extended or adjusted under 35 U.S.C. 154(b) by 666 days.

This patent is subject to a terminal disclaimer.

(21) Appl. No.: 13/866,056

(22) Filed: Apr. 19, 2013

(65) Prior Publication Data

US 2013/0233454 A1 Sep. 12, 2013

Related U.S. Application Data

(63) Continuation of application No. 12/581,497, filed on Oct. 19, 2009, now Pat. No. 8,444,776, which is a (Continued)

(51) Int. Cl.
*C21D 6/00* (2006.01)
*F41H 5/00* (2006.01)

(Continued)

(52) U.S. Cl.
CPC ..... *F41H 5/00* (2013.01); *C21D 6/001* (2013.01); *C21D 6/004* (2013.01); *C21D 6/005* (2013.01);

(Continued)

(58) Field of Classification Search
CPC ..... C21D 6/00; F41H 5/00

(Continued)

(56) References Cited

U.S. PATENT DOCUMENTS 1,016,560 A 2/1912 Giolitti
1,563,420 A 12/1925 Johnson et al.

(Continued)

FOREIGN PATENT DOCUMENTS

CN 1944715 A 4/2007
CN 101906588 A 12/2010

(Continued)

OTHER PUBLICATIONS

Armox™600T (Armox 600S) Data Sheet, SSAB Oxelösund AB, Jun. 6, 2006.

(Continued)

*Primary Examiner* — Jie Yang
(74) *Attorney, Agent, or Firm* — K&L Gates LLP

(57) ABSTRACT

An aspect of the present disclosure is directed to low-alloy steels exhibiting high hardness and an advantageous level of multi-hit ballistic resistance with low or no crack propagation imparting a level of ballistic performance suitable for military armor applications. Various embodiments of the steels according to the present disclosure have hardness in excess of 550 BHN and demonstrate a high level of ballistic penetration resistance relative to conventional military specifications.

10 Claims, 17 Drawing Sheets

Related U.S. Application Data continuation-in-part of application No. 12/184,573, filed on Aug. 1, 2008, now Pat. No. 9,121,088.

(60) Provisional application No. 60/953,269, filed on Aug. 1, 2007.

(51) Int. Cl.

| | |
|---|---|
| ***C21D 9/42*** | (2006.01) |
| ***C22C 38/00*** | (2006.01) |
| ***C22C 38/02*** | (2006.01) |
| ***C22C 38/04*** | (2006.01) |
| ***C22C 38/08*** | (2006.01) |
| ***C22C 38/44*** | (2006.01) |
| ***C22C 38/54*** | (2006.01) |

(52) U.S. Cl.

CPC ..... *C21D 6/008* (2013.01); *C21D 9/42* (2013.01); *C22C 38/005* (2013.01); *C22C 38/02* (2013.01); *C22C 38/04* (2013.01); *C22C 38/08* (2013.01); *C22C 38/44* (2013.01); *C22C 38/54* (2013.01); *C21D 2211/002* (2013.01); *C21D 2211/008* (2013.01)

(58) Field of Classification Search

USPC ..... 148/663

See application file for complete search history.

(56) References Cited

U.S. PATENT DOCUMENTS

| | | | |
|---|---|---|---|
| 2,249,629 | A | 7/1941 | Hopkins |
| 2,562,467 | A | 7/1951 | Kinnear, Jr. |
| 3,379,582 | A | 4/1968 | Dickinson |
| 3,785,801 | A | 1/1974 | Benjamin |
| 3,888,637 | A | 6/1975 | Taguchi et al. |
| 3,944,442 | A | 3/1976 | Donachie |
| 4,443,254 | A | 4/1984 | Floreen |
| 4,484,959 | A | 11/1984 | Boucher et al. |
| 4,645,720 | A | 2/1987 | Pircher et al. |
| 4,788,034 | A | 11/1988 | Brandis et al. |
| 4,832,909 | A | 5/1989 | Schmidt et al. |
| 4,871,511 | A | 10/1989 | Smith, Jr. et al. |
| 4,917,969 | A | 4/1990 | Pircher et al. |
| 4,941,927 | A | 7/1990 | Hickey, Jr. et al. |
| 5,122,336 | A | 6/1992 | Roux et al. |
| 5,129,966 | A | 7/1992 | Rao |
| 5,268,044 | A | 12/1993 | Hemphill et al. |
| 5,332,545 | A | 7/1994 | Love |
| 5,720,829 | A | 2/1998 | Finkl et al. |
| 5,749,140 | A | 5/1998 | Polito et al. |
| 5,866,066 | A | 2/1999 | Hemphill et al. |
| 5,997,665 | A | 12/1999 | Brisson et al. |
| 6,080,359 | A | 6/2000 | Davidson |
| 6,087,013 | A | 7/2000 | Chilson |
| 6,360,936 | B1 | 3/2002 | Dilg et al. |
| 6,361,883 | B1 | 3/2002 | Dilg et al. |
| 7,462,251 | B2 | 12/2008 | Beguinot et al. |
| 7,475,478 | B2 | 1/2009 | McCrink et al. |
| 7,537,727 | B2 | 5/2009 | Dilmore et al. |
| 7,926,180 | B2 | 4/2011 | McCrink et al. |
| 7,981,521 | B2 | 7/2011 | Bailey et al. |
| 8,361,254 | B2 | 1/2013 | Bailey et al. |
| 8,444,776 | B1 | 5/2013 | Bailey et al. |
| 8,529,708 | B2 | 9/2013 | Locke |
| 2003/0145911 | A1 | 8/2003 | Hoffmann et al. |
| 2011/0067788 | A1 | 3/2011 | Swiatek et al. |
| 2012/0174760 | A1 | 7/2012 | Stefansson |
| 2012/0183430 | A1 | 7/2012 | Bailey et al. |
| 2012/0321504 | A1 | 12/2012 | Stefansson et al. |
| 2015/0322554 | A1 | 11/2015 | Bailey et al. |
| 2016/0017455 | A1 | 1/2016 | Stefansson et al. |

FOREIGN PATENT DOCUMENTS

| | | | |
|---|---|---|---|
| DE | 2142360 | A1 | 4/1972 |
| DE | 4107417 | A1 | 12/1991 |
| DE | 4344879 | A1 | 7/1995 |
| EP | 051401 | A1 | 5/1982 |
| EP | 327042 | A1 | 8/1989 |
| EP | 0731332 | A2 | 9/1996 |
| EP | 1111325 | A2 | 6/2001 |
| EP | 2036992 | A1 | 3/2009 |
| FR | 2106939 | | 5/1972 |
| GB | 763442 | | 12/1956 |
| GB | 874488 | | 8/1961 |
| GB | 2054110 | A | 2/1981 |
| JP | S47-31808 | B | 8/1972 |
| JP | S47-31809 | | 12/1972 |
| JP | S49-9899 | A | 1/1974 |
| JP | 57-41351 | A | 3/1982 |
| JP | 57-83575 | A | 5/1982 |
| JP | 58-157950 | A | 9/1983 |
| JP | 58-199846 | A | 11/1983 |
| JP | 59-6356 | A | 1/1984 |
| JP | 59-47363 | | 3/1984 |
| JP | 60-29446 | A | 2/1985 |
| JP | H01-296098 | A | 11/1989 |
| JP | 4-197588 | A | 7/1992 |
| JP | 07-173573 | A | 7/1995 |
| JP | 57-161049 | A | 10/2002 |
| RU | 2090828 | C1 | 9/1997 |
| RU | 2102688 | C1 | 1/1998 |
| RU | 2139357 | C1 | 10/1999 |
| RU | 2297460 | C1 | 4/2007 |
| RU | 2309190 | C2 | 10/2007 |
| RU | 2388986 | C2 | 5/2010 |
| SU | 404889 | | 10/1973 |
| SU | 685711 | A1 | 9/1979 |
| WO | WO 2004/111277 | A1 | 12/2004 |
| WO | WO 2009/018522 | A1 | 2/2009 |
| WO | WO 2011/037759 | A2 | 3/2011 |
| WO | WO 2012/094160 | A2 | 7/2012 |

OTHER PUBLICATIONS

"K12® Dual Hardness Armor Plate", Technical Data Sheet, Allegheny Ludlum, 2002.

"Allegheny Ludlum AL 600™ (UNS Designation N6600) Nickel-Base Alloy", Technical Data Blue Sheet, Allegheny Ludlum Corporation, Pittsburgh, PA, 1998.

Hickey et al., "Comparing a Split Heat of ESR/VAR 4340 Steel", Metal Progress, Oct. 1985, pp. 69-74.

"Steels Double Up for Composites," The Iron Age, Nov. 16, 1967, pp. 70-72.

Rathbone, A.M. "Review of Recent An-nor Plate Developments", Blast Furnace and Steel Plant, Jul. 1968, pp. 575-583.

ATI 600-MIL® Ultra High Hard Specialt Armor; Version 4; Aug. 10, 2010.

ATI 500-MIL® High Hard Specialty Armor; Version 5; Aug. 10, 2010.

ATI-K12®-MIL Dual Hard Armor Plate; Version 3; Sep. 10, 2009.

ATI-K12®-MIL Dual Hard Armor Plate; Version 4; Aug. 10, 2010.

Military Specification MIL-A-12560H (MR); Nov. 28, 1990.

Military Specification MIL-DTL-32332 (MR); Jul. 24, 2009.

Military Specification MIL-DTL-46100E (MR) ; Jul. 9, 2008.

Military Specification MIL-DTL-12560J (MR); Jul. 24, 2009.

Military Specification MIL-A-46099C; Sep. 14, 1987.

Military Specification MIL-A-46100D (MR) with int. amendment 2; Jul. 13, 2007.

ASTM International, Standard Specification for Steel Bars, Designation: A29/A29M—05, Carbon and Alloy, Hot Wrought, General Requirements for, 2005, pp. 1-16.

Alloy Digest, Data on World Wide Metals and Alloys, AISI 4820 (Nickel-Molybdenum Carburizing Steel), Nov. 1974, 2 pages.

Data Sheet entitled "VascoMax T-200/T-250/T-300" Teledyne Vasco 1985, pp. 2-11.

(56) References Cited

OTHER PUBLICATIONS

U.S. Appl. No. 12/986,213, filed Jan. 7, 2011.
Definition of "cross rolling", The Metals Handbook Desk Edition, 2nd Edition, published by ASM International of Metals Park, Ohio, 1998, p. 17.
Sulfide Inclusions in Steel, Proceedings of an International Symposium, Nov. 7-8, 1974, Port Chester, New York, pp. 206, 255-256.
Metals Handbook, Tenth Edition, vol. 1, Properties and Selection: Irons, Steels, and High-Performance Alloys, J.R. Davis, editor, published by ASM International, Materials Park, OH, 1990, p. 400.
DeArdo and E.G. Hamburg: "Influence of Elongated Inclusions on the Mechanical Properties of High Strength Steel Plate," Sulfide Inclusions in Steel, J.J. de Barbadillo and E. Snape, ed., American Society for Metals, Metals Park, OH, 1975, pp. 309-337; 359.
ASTM International, Standard Test Methods and Definitions for Mechanical Testing of Steel Products: A370-10, approved Jun. 15, 2010, published Jul. 2010, pp. 1-47.
Canale, L. et al., "A Historical Overview of Steel Tempering Parameters", Dec. 31, 2008, Int. J. Microstructure and Materials Properties, vol. 3, Nos. 4/5, pp. 474-525.
Zhang et al., "Microstructure evolution of hot-work tool steels during tempering and definition of a kinetic law based on hardness measurements", Materials Science and Engineering A, 380, Mar. 22, 2004, pp. 222-230.
Crucible Selector—Crucible S7 XL, Crucible Industries, Sep. 10, 2010, 2 pages.
Hardness conversion chart downloaded from www.carbidedepot.com on Feb. 9, 2014.
Showalter et al., "Development and Ballistic Testing of a New Class of Auto-tempered High Hard Steels", ARL-TR-4997, Sep. 2009, pp. 1-36.
A Collection of Translated Essays in Heat Treatment (IV)—Vacuum Heat Treatment Special, Shanghai Institute of Machine Building Technology, Jan. 31, 1978, p. 10.

HIGH HARDNESS, HIGH TOUGHNESS IRON-BASE ALLOYS AND METHODS FOR MAKING SAME

CROSS-REFERENCE TO RELATED APPLICATIONS

This patent application is a continuation application, and claims the benefit of the filing date under 35 U.S.C. §120, of U.S. patent application Ser. No. 12/581,497, filed on Oct. 19, 2009. U.S. patent application Ser. No. 12/581,497 is a continuation-in-part application, and claims the benefit of the filing date under 35 U.S.C. §120, of U.S. patent application Ser. No. 12/184,573, filed on Aug. 1, 2008. U.S. patent application Ser. No. 12/184,573 claims priority under 35 U.S.C. §119(e) to U.S. Provisional Patent Application No. 60/953,269, filed on Aug. 1, 2007. U.S. patent application Ser. Nos. 12/581,497; 12/184,573; and 60/953,269 are incorporated by reference herein.

TECHNICAL FIELD

The present disclosure relates to iron-base alloys having hardness greater than 550 BHN (Brinell hardness number) and demonstrating substantial and unexpected penetration resistance and crack resistance in standard ballistic testing. The present disclosure also relates to armor and other articles of manufacture including the alloys. The present disclosure further relates to methods of processing various iron-base alloys so as to improve resistance to ballistic penetration and cracking.

BACKGROUND

Armor plate, sheet, and bar are commonly provided to protect structures against forcibly launched projectiles. Although armor plate, sheet, and bar are typically used in military applications as a means to protect personnel and property within, for example, vehicles and mechanized armaments, the products also have various civilian uses. Such uses may include, for example, sheathing for armored civilian vehicles and blast-fortified property enclosures. Armor has been produced from a variety of materials including, for example, polymers, ceramics, and metallic alloys. Because armor is often mounted on mobile articles, armor weight is typically an important factor. Also, the costs associated with producing armor can be substantial, and particularly so in connection with exotic armor alloys, ceramics, and specialty polymers. As such, an objective has been to provide lower-cost yet effective alternatives to existing armors, and without significantly increasing the weight of armor necessary to achieve the desired level of ballistic performance (penetration resistance and cracking resistance).

Also, in response to ever-increasing anti-armor threats, the United States military had for many years been increasing the amount of armor used on tanks and other combat vehicles, resulting in significantly increased vehicle weight. Continuing such a trend could drastically adversely affect transportability, portable bridge-crossing capability, and maneuverability of armored combat vehicles. Within the past decade the U.S. military has adopted a strategy to be able to very quickly mobilize its combat vehicles and other armored assets to any region in the world as the need may arise. Thus, concern over increasing combat vehicle weight has taken center stage. As such, the U.S. military has been investigating a number of possible alternative, lighter-weight armor materials, such as certain titanium alloys, ceramics, and hybrid ceramic tile/polymer-matrix composites (PMCs).

Examples of common titanium alloy armors include Ti-6Al-4V, Ti-6Al-4V ELI, and Ti-4Al-2.5V—Fe—O. Titanium alloys offer many advantages relative to more conventional rolled homogenous steel armor. Titanium alloys have a high mass efficiency compared with rolled homogenous steel and aluminum alloys across a broad spectrum of ballistic threats, and also provide favorable multi-hit ballistic penetration resistance capability. Titanium alloys also exhibit generally higher strength-to-weight ratios, as well as substantial corrosion resistance, typically resulting in lower asset maintenance costs. Titanium alloys may be readily fabricated in existing production facilities, and titanium scrap and mill revert can be remelted and recycled on a commercial scale. Nevertheless, titanium alloys do have disadvantages. For example, a spall liner typically is required, and the costs associated with manufacturing the titanium armor plate and fabricating products from the material (for example, machining and welding costs) are substantially higher than for rolled homogenous steel armors.

Although PMCs offer some advantages (for example, freedom from spalling against chemical threats, quieter operator environment, and high mass efficiency against ball and fragment ballistic threats), they also suffer from a number of disadvantages. For example, the cost of fabricating PMC components is high compared with the cost for fabricating components from rolled homogenous steel or titanium alloys, and PMCs cannot readily be fabricated in existing production facilities. Also, non-destructive testing of PMC materials may not be as well advanced as for testing of alloy armors. Moreover, multi-hit ballistic penetration resistance capability and automotive load-bearing capacity of PMCs can be adversely affected by structural changes that occur as the result of an initial projectile strike. In addition, there may be a fire and fume hazard to occupants in the interior of combat vehicles covered with PMC armor, and PMC commercial manufacturing and recycling capabilities are not well established.

Metallic alloys are often the material of choice when selecting an armor material. Metallic alloys offer substantial multi-hit protection, typically are inexpensive to produce relative to exotic ceramics, polymers, and composites, and may be readily fabricated into components for armored combat vehicles and mobile armament systems. It is conventionally believed that it is advantageous to use materials having very high hardnesses in armor applications because projectiles are more likely to fragment when impacting higher hardness materials. Certain metallic alloys used in armor application may be readily processed to high hardnesses, typically by quenching the alloys from very high temperatures.

Because rolled homogenous steel alloys are generally less expensive than titanium alloys, substantial effort has focused on modifying the composition and processing of existing rolled homogenous steels used in armor applications since even incremental improvements in ballistic performance are significant. For example, improved ballistic threat performance can allow for reduced armor plating thicknesses without loss of function, thereby reducing the overall weight of an armor system. Because high system weight is a primary drawback of metallic alloy systems relative to, for example, polymer and ceramic armors, improving ballistic threat performance can make alloy armors more competitive relative to exotic armor systems.

Over the last 25 years, relatively light-weight clad and composite steel armors have been developed. Certain of these composite armors, for example, combine a front-facing layer of high-hardness steel metallurgically bonded to a tough, penetration resistant steel base layer. The high-hardness steel layer is intended to break up the projectile, while the tough underlayer is intended to prevent the armor from cracking, shattering, or spalling. Conventional methods of forming a composite armor of this type include roll bonding stacked plates of the two steel types. One example of a composite armor is K12® armor plate, which is a dual hardness, roll-bonded composite armor plate available from ATI Allegheny Ludlum, Pittsburgh, Pa. K12® armor plate includes a high hardness front side and a softer back side. Both faces of the K12® armor plate are Ni—Mo—Cr alloy steel, but the front side includes higher carbon content than the back side. K12® armor plate has superior ballistic performance properties compared to conventional homogenous armor plate and meets or exceeds the ballistic requirements for numerous government, military, and civilian armoring applications. Although clad and composite steel armors offer numerous advantages, the additional processing involved in the cladding or roll bonding process necessarily increases the cost of the armor systems.

Relatively inexpensive low alloy content steels also are used in certain armor applications. As a result of alloying with carbon, chromium, molybdenum, and other elements, and the use of appropriate heating, quenching, and tempering steps, certain low alloy steel armors can be produced with very high hardness properties, greater than 550 BHN. Such high hardness steels are commonly known as "600 BHN" steels. Table 1 provides reported compositions and mechanical properties for several examples of available 600 BHN steels used in armor applications. MARS 300 and MARS 300 Ni+ are produced by the French company Arcelor. ARMOX 600T armor is available from SSAB Oxelosund AB, Sweden. Although the high hardness of 600 BHN steel armors is very effective at breaking up or flattening projectiles, a significant disadvantage of these steels is that they tend be rather brittle and readily crack when ballistic tested against, for example, armor piercing projectiles. Cracking of the materials can be problematic to providing multi-hit ballistic resistance capability.

TABLE 1

| Alloy | C | Mn | P (max) | S (max) | Si | Cr | Ni | Mo | Yield Strength (Mpa) | Tensile Strength (Mpa) | Elong. (%) | BHN (min) |
|---|---|---|---|---|---|---|---|---|---|---|---|---|
| Mars 300 | 0.45-0.55 | 0.3-0.7 | 0.012 | 0.005 | 0.6-1.0 | 0.4 (max) | 4.5 (max) | 0.3-0.5 | ≥1,300 | ≥2,000 | ≥6% | 578-655 |
| Mars 300 Ni+ | 0.45-0.55 | 0.3-0.7 | 0.01 | 0.005 | 0.6-1.0 | 0.01-0.04 | 3.5-4.5 | 0.3-0.5 | ≥1,300 | ≥2,000 | ≥6% | 578-655 |
| Armox 600 | 0.47 (max) | 1.0 (max) | 0.010 | 0.005 | 0.1-0.7 | 1.5 (max) | 3.0 (max) | 0.7 (max) | 1,500 (typical) | 2,000 (typical) | ≥7% | 570-640 |

In light of the foregoing, it would be advantageous to provide an improved steel armor material having hardness within the 600 BHN range and having substantial multi-hit ballistic resistance with reduced crack propagation.

SUMMARY

According to various non-limiting embodiments of the present disclosure, an iron-base alloy is provided having favorable multi-hit ballistic resistance, hardness greater than 550 BHN, and including, in weight percentages based on total alloy weight: 0.40 to 0.53 carbon; 0.15 to 1.00 manganese; 0.15 to 0.45 silicon; 0.95 to 1.70 chromium; 3.30 to 4.30 nickel; 0.35 to 0.65 molybdenum; 0.0002 to 0.0050 boron; 0.001 to 0.015 cerium; 0.001 to 0.015 lanthanum; no greater than 0.002 sulfur; no greater than 0.015 phosphorus; no greater than 0.011 nitrogen; iron; and incidental impurities.

According to various other non-limiting embodiments of the present disclosure, an alloy mill product such as, for example, a plate, a bar, or a sheet, is provided having hardness greater than 550 BHN and including, in weight percentages based on total alloy weight: 0.40 to 0.53 carbon; 0.15 to 1.00 manganese; 0.15 to 0.45 silicon; 0.95 to 1.70 chromium; 3.30 to 4.30 nickel; 0.35 to 0.65 molybdenum; 0.0002 to 0.0050 boron; 0.001 to 0.015 cerium; 0.001 to 0.015 lanthanum; no greater than 0.002 sulfur; no greater than 0.015 phosphorus; no greater than 0.011 nitrogen; iron; and incidental impurities.

According to various other non-limiting embodiments of the present disclosure, an armor mill product selected from an armor plate, an armor bar, and an armor sheet is provided having hardness greater than 550 BHN and a $V_{50}$ ballistic limit (protection) value that meets or exceeds performance requirements under specification MIL-DTL-46100E. In various embodiments the armor mill product also has a $V_{50}$ ballistic limit value that is at least as great as a $V_{50}$ ballistic limit value that is 150 feet-per-second less than the performance requirements under specification MIL-A-46099C with reduced or minimal crack propagation. The mill product is an alloy including, in weight percentages based on total alloy weight: 0.40 to 0.53 carbon; 0.15 to 1.00 manganese; 0.15 to 0.45 silicon; 0.95 to 1.70 chromium; 3.30 to 4.30 nickel; 0.35 to 0.65 molybdenum; 0.0002 to 0.0050 boron; 0.001 to 0.015 cerium; 0.001 to 0.015 lanthanum; no greater than 0.002 sulfur; no greater than 0.015 phosphorus; no greater than 0.011 nitrogen; iron; and incidental impurities.

According to various other non-limiting embodiments of the present disclosure, an armor mill product selected from an armor plate, an armor bar, and an armor sheet is provided having hardness greater than 550 BHN and a $V_{50}$ ballistic limit (protection) value that meets or exceeds the Class 1 performance requirements under specification MIL-DTL-32332. In various embodiments the armor mill product also has a $V_{50}$ ballistic limit value that is at least as great as a $V_{50}$ ballistic limit value that is 150 feet-per-second less than the Class 2 performance requirements under specification MIL-DTL-32332. The mill product is an alloy including, in weight percentages based on total alloy weight: 0.40 to 0.53 carbon; 0.15 to 1.00 manganese; 0.15 to 0.45 silicon; 0.95 to 1.70 chromium; 3.30 to 4.30 nickel; 0.35 to 0.65 molybdenum; 0.0002 to 0.0050 boron; 0.001 to 0.015 cerium; 0.001 to 0.015 lanthanum; no greater than 0.002 sulfur; no greater than 0.015 phosphorus; no greater than 0.011 nitrogen; iron; and incidental impurities.

Various embodiments according to the present disclosure are directed to a method of making an alloy having favorable multi-hit ballistic resistance with reduced or minimal crack propagation and hardness greater than 550 BHN, and wherein the mill product is an alloy including, in weight percentages based on total alloy weight: 0.40 to 0.53 carbon; 0.15 to 1.00 manganese; 0.15 to 0.45 silicon; 0.95 to 1.70 chromium; 3.30 to 4.30 nickel; 0.35 to 0.65 molybdenum; 0.0002 to 0.0050 boron; 0.001 to 0.015 cerium; 0.001 to 0.015 lanthanum; no greater than 0.002 sulfur; no greater than 0.015 phosphorus; no greater than 0.011 nitrogen; iron; and incidental impurities. The alloy is austenitized by heating the alloy to a temperature of at least 1450° F. The alloy is then cooled from the austenitizing temperature in a manner that differs from the conventional manner of cooling armor alloy from the austenitizing temperature and which alters the path of the cooling curve of the alloy relative to the path the curve would assume if the alloy were cooled in a conventional manner. Cooling the alloy from the austenitizing temperature may provide the alloy with a $V_{50}$ ballistic limit value that meets or exceeds the required $V_{50}$ ballistic limit value under specification MIL-DTL-46100E, and in various embodiments under MIL-DTL-32332 (Class 1).

In various embodiments, cooling the alloy from the austenitizing temperature provides the alloy with a $V_{50}$ ballistic limit value that is no less than a value that is 150 feet-per-second less than the required $V_{50}$ ballistic limit value under specification MIL-A-46099C, and in various embodiments under specification MIL-DTL-32332 (Class 2), with reduced or minimal crack propagation. In other words, the $V_{50}$ ballistic limit value is at least as great as a $V_{50}$ ballistic limit value 150 feet-per-second less than the required $V_{50}$ ballistic limit value under specification MIL-A-46099C, and in various embodiments under specification MIL-DTL-32332 (Class 2), with reduced or minimal crack propagation.

According to various non-limiting embodiments of a method according to the present disclosure, the step of cooling the alloy comprises simultaneously cooling multiple plates of the alloy from the austenitizing temperature with the plates arranged in contact with one another.

In various embodiments, an alloy article is austenitized by heating the alloy article to a temperature of at least 1450° F. The alloy article is then cooled from the austenitizing temperature in a conventional manner of cooling steel alloys from the austenitizing temperature. The cooled alloy is then tempered at a temperature in the range 250° F. to 500° F. Cooling the alloy from the austenitizing temperature and tempering may provide the alloy with a $V_{50}$ ballistic limit value that meets or exceeds the required $V_{50}$ ballistic limit value under specification MIL-DTL-46100E, and in various embodiments under specification MIL-DTL-32332 (Class 1).

In various embodiments, conventional cooling of the alloy article from the austenitizing temperature and tempering provides the alloy article with a $V_{50}$ ballistic limit value that is no less than a value that is 150 feet-per-second less than the required $V_{50}$ ballistic limit value under specification MIL-A-46099C, and in various embodiments under specification MIL-DTL-32332 (Class 2), with reduced, minimal, or zero crack propagation. In other words, the $V_{50}$ ballistic limit value is at least as great as a $V_{50}$ ballistic limit value 150 feet-per-second less than the required $V_{50}$ ballistic limit value under specification MIL-A-46099C, and in various embodiments under specification MIL-DTL-32332 (Class 2).

In various embodiments, the alloy article may be an alloy plate or an alloy sheet. An alloy sheet or an alloy plate may be an armor sheet or an armor plate. Other embodiments of the present disclosure are directed to articles of manufacture comprising embodiments of alloys and alloy articles according to the present disclosure. Such articles of manufacture include, for example, armored vehicles, armored enclosures, and items of armored mobile equipment.

It is understood that the invention disclosed and described herein is not limited to the embodiments disclosed in this Summary.

BRIEF DESCRIPTION OF THE DRAWINGS

Various characteristics of the non-limiting embodiments disclosed and described herein may be better understood by reference to the accompanying figures, in which.

Figure 1:
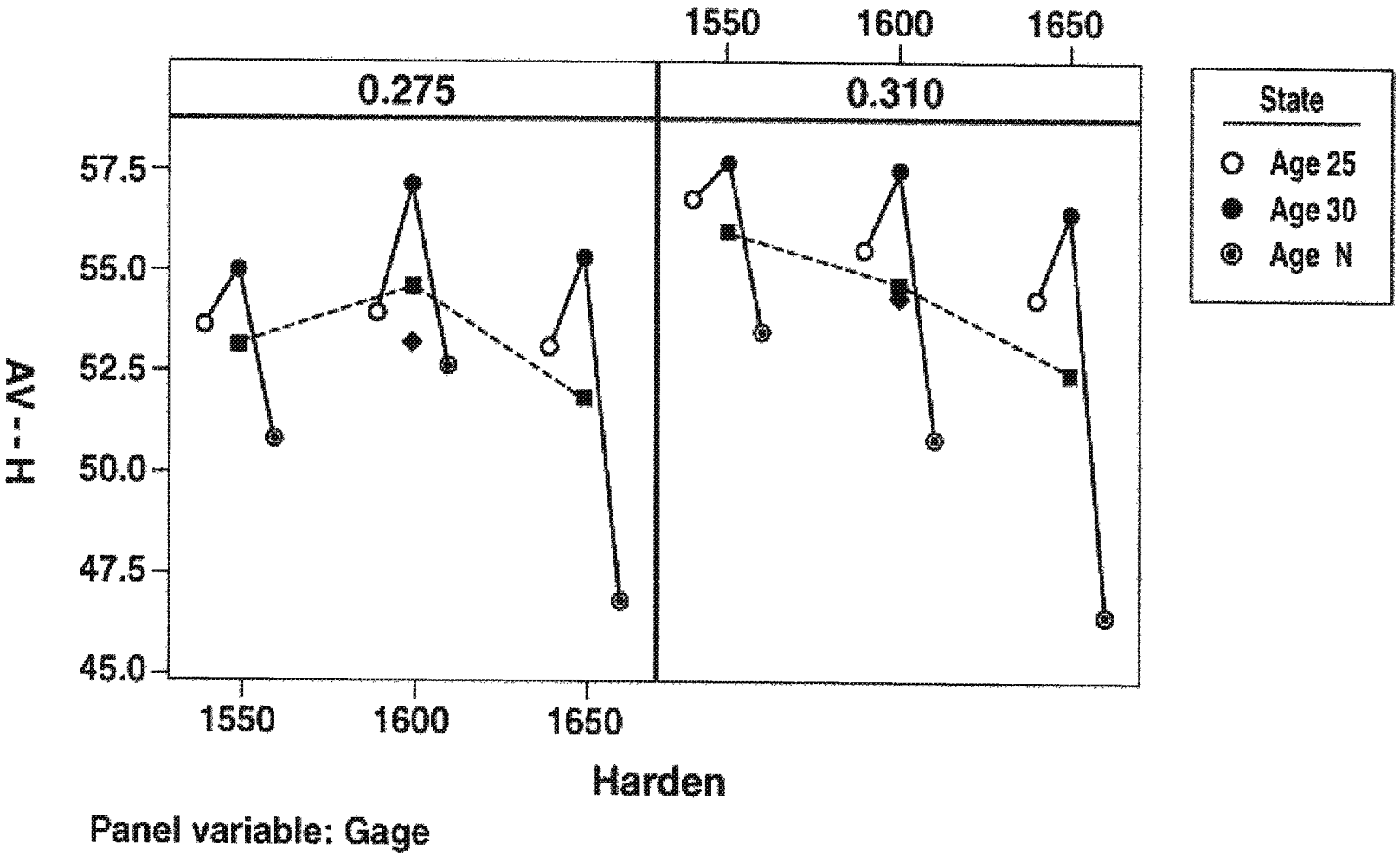
FIG. 1 is a plot of HRC hardness as a function of austenitizing treatment heating temperature for certain experimental plate samples processed as described hereinbelow.

The reader will appreciate the foregoing details, as well as others, upon considering the following detailed description of various non-limiting embodiments of alloys, articles, and methods according to the present disclosure. The reader also may comprehend additional details upon implementing or using the alloys, articles, and methods described herein.

DETAILED DESCRIPTION OF NON-LIMITING EMBODIMENTS

It is to be understood that various descriptions of the disclosed embodiments have been simplified to illustrate only those elements, features, and aspects that are relevant to a clear understanding of the disclosed embodiments, while eliminating, for purposes of clarity, other characteristics, features, aspects, and the like. Persons having ordinary skill in the art, upon considering the present description of the disclosed embodiments, will recognize that other characteristics, features, aspects, and the like may be desirable in a particular implementation or application of the disclosed embodiments. However, because such other characteristics, features, aspects, and the like may be readily ascertained and implemented by persons having ordinary skill in the art upon considering the present description of the disclosed embodiments, and are, therefore, not necessary for a complete understanding of the disclosed embodiments, a description of such characteristics, features, aspects, and the like is not provided herein. As such, it is to be understood that the description set forth herein is merely exemplary and illustrative of the disclosed embodiments and is not intended to limit the scope of the invention as defined solely by the claims.

In the present disclosure, other than where otherwise indicated, all numbers expressing quantities or characteristics are to be understood as being prefaced and modified in all instances by the term "about." Accordingly, unless indicated to the contrary, any numerical parameters set forth in the following description may vary depending on the desired properties one seeks to obtain in the compositions and methods according to the present disclosure. At the very least, and not as an attempt to limit the application of the doctrine of equivalents to the scope of the claims, each numerical parameter described in the present description should at least be construed in light of the number of reported significant digits and by applying ordinary rounding techniques.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. §112, first paragraph, and 35 U.S.C. §132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

Any patent, publication, or other disclosure material, in whole or in part, that is said to be incorporated by reference herein, is incorporated herein in its entirety, but only to the extent that the incorporated material does not conflict with existing definitions, statements, or other disclosure material expressly set forth in this disclosure. As such, and to the extent necessary, the express disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material. Applicants reserve the right to amend the present disclosure to expressly recite any subject matter incorporated by reference herein.

The present disclosure includes descriptions of various embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure.

The present disclosure, in part, is directed to low-alloy steels having significant hardness and demonstrating a substantial and unexpected level of multi-hit ballistic resistance with reduced, minimal, or zero cracking and/or crack propagation, which imparts a level of ballistic penetration resistance suitable for military armor applications, for example. Various embodiments of the steels according to the present disclosure exhibit hardness values in excess of 550 BHN and demonstrate a substantial level of ballistic penetration resistance when evaluated as per MIL-DTL-46100E, and also when evaluated per MIL-A-46099C. Various embodiments of the steels according to the present disclosure exhibit hardness values in excess of 570 BHN and demonstrate a substantial level of ballistic penetration resistance when evaluated as per MIL-DTL-32332, Class 1 or Class 2. United States Military Specifications "MIL-DTL-46100E", "MIL-A-46099C", and "MIL-DTL-32332" are incorporated by reference herein.

Relative to certain existing 600 BHN steel armor plate materials, various embodiments of the alloys according to the present disclosure are significantly less susceptible to cracking and penetration when tested against armor piercing ("AP") projectiles. Various embodiments of the alloys also have demonstrated ballistic performance that is comparable to the performance of high-alloy armor materials, such as, for example, K-12® armor plate. The ballistic performance of various embodiments of steel alloys according to the present disclosure was wholly unexpected given, for example, the low alloy content of the alloys and the alloys' relatively moderate hardness compared to conventional 600 BHN steel armor materials.

More particularly, it was unexpectedly observed that although various embodiments of alloys according to the present disclosure exhibit relatively moderate hardnesses (which can be provided by cooling the alloys from austenitizing temperatures at a relatively slow cooling rate or at conventional rates), the samples of the alloys exhibited substantial ballistic performance, which was at least comparable to the performance of K-12® armor plate. This surprising and unobvious discovery runs directly counter to the conventional belief that increasing the hardness of steel armor plate materials improves ballistic performance.

Various embodiments of steels according to the present disclosure include low levels of the residual elements sulfur, phosphorus, nitrogen, and oxygen. Also, various embodiments of the steels may include concentrations of one or more of cerium, lanthanum, and other rare earth metals. Without being bound to any particular theory of operation, the inventors believe that the rare earth additions may act to bind some portion of sulfur, phosphorus, and/or oxygen present in the alloy so that these residuals are less likely to concentrate in grain boundaries and reduce the multi-hit ballistic resistance of the material. It is further believed that concentrating sulfur, phosphorus, and/or oxygen within the steels' grain boundaries may promote intergranular separation upon high velocity impact, leading to material fracture, crack propagation, and possible penetration of the impacting projectile. Various embodiments of the steels according to the present disclosure also include relatively high nickel content, for example 3.30 to 4.30 weight percent, to provide a relatively tough matrix, thereby significantly improving ballistic performance. In various embodiments, the nickel content may comprise 3.75 to 4.25 weight percent of the steels disclosed herein.

In various embodiments, the steel alloys disclosed herein may comprise (in weight percentages based on total alloy weight): 0.40 to 0.53 carbon; 0.15 to 1.00 manganese; 0.15 to 0.45 silicon; 0.95 to 1.70 chromium; 3.30 to 4.30 nickel; 0.35 to 0.65 molybdenum; no greater than 0.002 sulfur; no greater than 0.015 phosphorus; no greater than 0.11 nitrogen; iron; and incidental impurities. In various embodiments, the steel alloys may also comprise 0.0002 to 0.0050 boron; 0.001 to 0.015 cerium; and/or 0.001 to 0.015 lanthanum.

In various embodiments, the carbon content may comprise any sub-range within 0.40 to 0.53 weight percent, such as, for example, 0.48 to 0.52 weight percent or 0.49 to 0.51 weight percent. The manganese content may comprise any sub-range within 0.15 to 1.00 weight percent, such as, for example, 0.20 to 0.80 weight percent. The silicon content may comprise any sub-range within 0.15 to 0.45 weight percent, such as, for example, 0.20 to 0.40 weight percent. The chromium content may comprise any sub-range within 0.95 to 1.70 weight percent, such as, for example, 1.00 to 1.50 weight percent. The nickel content may comprise any sub-range within 3.30 to 4.30 weight percent, such as, for example, 3.75 to 4.25 weight percent. The molybdenum content may comprise any sub-range within 0.35 to 0.65 weight percent, such as, for example, 0.40 to 0.60 weight percent.

In various embodiments, the sulfur content may comprise a content no greater than 0.001 weight percent, the phosphorus content may comprise a content no greater than 0.010 weight percent, and/or the nitrogen content may comprise a content no greater than 0.0.10 weight percent. In various embodiments, the boron content may comprise any sub-range within 0.0002 to 0.0050 weight percent, such as, for example, 0.008 to 0.0024, 0.0010 to 0.0030, or 0.0015 to 0.0025 weight percent. The cerium content may comprise any sub-range within 0.001 to 0.015 weight percent, such as, for example, 0.003 to 0.010 weight percent. The lanthanum content may comprise any sub-range within 0.001 to 0.015 weight percent, such as, for example, 0.002 to 0.010 weight percent.

In addition to developing a unique alloy system, the inventors also conducted studies, discussed below, to determine how one may process steels within the present disclosure to improve hardness and ballistic performance as evaluated per known military specifications MIL-DTL-46100E, MIL-A-46099C, and MIL-DTL-32332. The inventors also subjected samples of steel according to the present disclosure to various temperatures intended to dissolve carbide particles within the steel and to allow diffusion and produce an advantageous degree of homogeneity within the steel. An objective of this testing was to determine heat treating temperatures that do not produce excessive carburization or result in excessive and unacceptable grain growth, which would reduce material toughness and thereby degrade ballistic performance. In various processes, plates of the steel were cross rolled to provide some degree of isotropy.

It is also believed that various embodiments of the processing methods described herein impart a particular microstructure to the steel alloys. For example, in various embodiments, the disclosed steels are cooled from austenitizing temperatures to form martensite. The cooled alloys may contain a significant amount of twinned martensite and various amounts of retained austenite. Tempering of the cooled alloys according to various embodiments described herein may transform the retained austenite to lower bainite and/or lath martensite. This may result in steel alloys having a synergistic combination of hard twinned martensite microstructure and tougher, more ductile lower bainite and/or lath martensite microstructure. A synergistic combination of hardness, toughness, and ductility may impart excellent ballistic penetration and crack resistance properties to the alloys described herein.

Trials evaluating the ballistic performance of samples cooled at different rates from austenitizing temperature, and therefore having differing hardnesses, also were conducted. The inventors' testing also included tempering trials and cooling trials intended to assess how best to promote multi-hit ballistic resistance with reduced, minimal, or zero crack propagation. Samples were evaluated by determining $V_{50}$ ballistic limit values of the various test samples per MIL-DTL-46100E, MIL-A-46099C, and MIL-DTL-32332 using 7.62 mm (.30 caliber M2, AP) projectiles. Details of the inventors' alloy studies follow.

1. Preparation of Experimental Alloy Plates

A novel composition for low-alloy steel armors was formulated. The present inventors concluded that such alloy composition preferably should include relatively high nickel content and low levels of sulfur, phosphorus, and nitrogen residual elements, and should be processed to plate form in a way that promotes homogeneity. Several ingots of an alloy having the experimental chemistry shown in Table 2 were prepared by argon-oxygen-decarburization ("AOD") or AOD and electroslag remelting ("ESR"). Table 2 indicates the desired minimum and maximum, a preferred minimum and a preferred maximum (if any), and a nominal aim level of the alloying elements, as well as the actual chemistry of the alloy produced. The balance of the alloy included iron and incidental impurities. Non-limiting examples of elements that may be present as incidental impurities include copper, aluminum, titanium, tungsten, and cobalt. Other potential incidental impurities, which may be derived from the starting materials and/or through alloy processing, will be known to persons having ordinary skill in metallurgy. Alloy compositions are reported in Table 2, and more generally are reported herein, as weight percentages based on total alloy weight unless otherwise indicated. Also, in Table 2, "LAP" refers to "low as possible",

TABLE 2

| | C | Mn | P | S | Si | Cr | Ni | Mo | Ce | La | V | W | Ti | Co | Al | N | B |
|---|---|---|---|---|---|---|---|---|---|---|---|---|---|---|---|---|---|
| Min. | .40 | .15 | — | — | .15 | .95 | 3.30 | .35 | .001 | .001 | — | — | — | — | — | — | .0002 |
| Max. | .53 | 1.00 | .015 | .002 | .45 | 1.70 | 4.30 | .65 | .015 | .015 | .05 | .08 | .05 | .05 | .020 | .010 | .0050 |
| Preferred Min. | .49 | .20 | — | — | .20 | 1.00 | 3.75 | .40 | .003 | .002 | — | — | — | — | — | — | .0010 |
| Preferred Max. | .51 | .80 | .010 | .001 | .40 | 1.50 | 4.25 | .60 | .010 | .010 | — | — | — | — | — | — | .0030 |
| Aim | .50 | .50 | LAP | LAP | .30 | 1.25 | 4.00 | .50 | — | — | LAP | LAP | LAP | LAP | LAP | LAP | .0016 |
| Actual* | .50 | .53 | .01 | .0006 | 0.4 | 1.24 | 4.01 | .52 | — | .003 | .01 | .01 | .002 | .02 | .02 | .007 | .0015 |

*Analysis revealed that the composition also included 0.09 copper, 0.004 niobium, 0.004 tin, 0.001 zirconium, and 92.62 iron.

Ingot surfaces were ground using conventional practices. The ingots were then heated to about 1300° F. (704° C.), equalized, held at this first temperature for 6 to 8 hours, heated at about 200° F./hour (93° C./hour) up to about 2050° F. (1121° C.), and held at the second temperature for about 30-40 minutes per inch of thickness. Ingots were then hot rolled to 6-7 inches (15.2-17.8 cm) thickness, end cropped and, if necessary, reheated to about 2050° F. (1121° C.) for 1-2 hours before subsequent additional hot rolling to re-slabs of about 1.50-2.65 inches (3.81-6.73 cm) in thickness. The re-slabs were stress relief annealed using conventional practices, and slab surfaces were then blast cleaned and finish rolled to long plates having finished gauge thicknesses ranging from about 0.188 inches (4.8 mm) to about 0.310 inch (7.8 mm). The long plates were then fully annealed, blast cleaned, flattened, and sheared to form multiple individual plates.

In certain cases, the re-slabs were reheated to rolling temperature immediately before the final rolling step necessary to achieve finished gauge. More specifically, certain plate samples were final rolled as shown in Table 3. Tests were conducted on samples of the 0.275 and 0.310 inch (7 and 7.8 mm) gauge (nominal) plates that were final rolled as shown in Table 3 to assess possible heat treatment parameters optimizing surface hardness and ballistic performance properties.

TABLE 3

| Approx. Thickness, inch (mm) | Hot Rolling Process Parameters |
|---|---|
| 0.275 (7) | Reheated slab at 0.5 for approx. 10 min. before rolling to finish gauge |
| 0.275 (7) | No re-heat immediately before rolling to finish gauge |
| 0.310 (7.8) | Reheated slab at 0.6 for approx. 30 min. before rolling to finish gauge |
| 0.310 (7.8) | No re-heat immediately before rolling to finish gauge |

2. Hardness Testing

Plates produced as in Section 1 above were subjected to an austenitizing treatment and a hardening step, cut into thirds to form samples for further testing and, optionally, subjected to a tempering treatment. The austenitizing treatment involved heating the samples to 1550-1650° F. (843-899° C.) for 40 minutes time-at-temperature. Hardening involved air-cooling the samples or quenching the samples in oil from the austenitizing treatment temperature to room temperature ("RT").

As used herein, the term "time-at-temperature" refers to the duration of the period of time that an article is maintained at a specified temperature after at least the surface of the article reaches that temperature. For example, the phrase "heating a sample to 1650° F. for 40 minutes time-at-temperature" means that the sample is heated to a temperature of 1650° F. and once the sample reaches 1650° F., the sample is maintained for 40 minutes at 1650°. After a specified time-at-temperature has elapsed, the temperature of an article may change from the specified temperature. As used herein, the term "minimum furnace time" refers to the minimum duration of the period of time that an article is located in a furnace that is heated to a specified temperature. For example, the phrase "heating a sample to 1650° F. for 40 minutes minimum furnace time" means that the sample is placed into a 1650° F. furnace for 40 minutes and then removed from the 1650° F. furnace.

One of the three samples from each austenitized and hardened plate was retained in the as-hardened state for testing. The remaining two samples cut from each austenitized and hardened plate were temper annealed by holding at either 250° F. (121° C.) or 300° F. (149° C.) for 90 minutes time-at-temperature. To reduce the time needed to evaluate sample hardness, all samples were initially tested using the Rockwell C ($HR_C$) test rather than the Brinell hardness test. The two samples exhibiting the highest $HR_C$ values in the as-hardened state were also tested to determine Brinell hardness (BHN) in the as-hardened state (i.e., before any tempering treatment). Table 4 lists austenitizing treatment temperatures, quench type, gauge, and $HR_C$ values for samples tempered at either 250° F. (121° C.) or 300° F. (149° C.). Table 4 also indicates whether the plates used in the testing were subjected to reheating immediately prior to rolling to final gauge. In addition, Table 4 lists BHN hardness for the untempered, as-hardened samples exhibiting the highest $HR_C$ values in the as-hardened condition.

TABLE 4

| Aus. Anneal Temp. (° F.) | Cooling Type | Reheat | Gauge | As-Hardened $HR_c$ | As-Hardened BHN | $HR_c$ Post 250° F. Anneal | $HR_c$ Post 300° F. Anneal |
|---|---|---|---|---|---|---|---|
| 1550 | Air | No | 0.275 | 50 | — | 54 | 54 |
| 1550 | Air | No | 0.310 | 53 | — | 58 | 57 |
| 1550 | Air | Yes | 0.275 | 50 | — | 53 | 56 |
| 1550 | Air | Yes | 0.310 | 50 | — | 55 | 57 |
| 1550 | Oil | No | 0.275 | 48 | — | 54 | 56 |
| 1550 | Oil | No | 0.310 | 53 | — | 58 | 58 |
| 1550 | Oil | Yes | 0275 | 59 | 624 | 52 | 53 |
| 1550 | Oil | Yes | 0.310 | 59 | — | 55 | 58 |
| 1600 | Air | No | 0.275 | 53 | 587 | 54 | 57 |
| 1600 | Air | No | 0.310 | 48 | — | 56 | 57 |
| 1600 | Air | Yes | 0.275 | 54 | — | 56 | 57 |
| 1600 | Air | Yes | 0.310 | 50 | — | 57 | 58 |
| 1600 | Oil | No | 0.275 | 53 | — | 54 | 57 |
| 1600 | Oil | No | 0.310 | 52 | — | 55 | 58 |
| 1600 | Oil | Yes | 0.275 | 51 | — | 51 | 58 |
| 1600 | Oil | Yes | 0.310 | 53 | — | 53 | 58 |
| 1650 | Air | No | 0.275 | 46 | — | 54 | 56 |
| 1650 | Air | No | 0.310 | 46 | — | 53 | 56 |
| 1650 | Air | Yes | 0.275 | 48 | — | 53 | 57 |
| 1650 | Air | Yes | 0.310 | 48 | — | 54 | 56 |
| 1650 | Oil | No | 0.275 | 47 | — | 52 | 55 |
| 1650 | Oil | No | 0.310 | 46 | — | 54 | 57 |
| 1650 | Oil | Yes | 0.275 | 46 | — | 55 | 54 |
| 1650 | Oil | Yes | 0.310 | 47 | — | 57 | 58 |

Table 5 provides average HRC values for the samples included in Table 4 in the as-hardened state and after temper anneals of either 250° F. (121° C.) or 300° F. (149° C.) for 90 minutes time-at-temperature.

TABLE 5

| Austenitizing Anneal Temp. (° F.) | Avg. $HR_c$ As-Hardened | Avg. $HR_c$ Post 250° F. Anneal | Avg. $HR_c$ Post 300° F. Anneal |
|---|---|---|---|
| 1550 | 52 | 55 | 56 |
| 1600 | 52 | 55 | 57 |
| 1650 | 47 | 54 | 56 |

In general, Brinell hardness is determined per specification ASTM E-10 by forcing an indenter in the form of a hard steel or carbide sphere of a specified diameter under a specified load into the surface of the sample and measuring the diameter of the indentation left after the test. The Brinell hardness number or "BHN" is obtained by dividing the indenter load used (in kilograms) by the actual surface area of the indentation (in square millimeters). The result is a pressure measurement, but the units are rarely stated when BHN values are reported.

In assessing the Brinell hardness number of steel armor samples, a desk top machine is used to press a 10 mm diameter tungsten carbide sphere indenter into the surface of the test specimen. The machine applies a load of 3000 kilograms, usually for 10 seconds. After the ball is retracted, the diameter of the resulting round impression is determined. The BHN value is calculated according to the following formula:

$$BHN=2P/[\pi D(D-(D^2-d^2)^{1/2})],$$

where BHN=Brinell hardness number; P=the imposed load in kilograms; D=the diameter of the spherical indenter in mm; and d=the diameter of the resulting indenter impression in millimeters.

Several BHN tests may be carried out on a surface region of an armor plate and each test might result in a slightly different hardness number. This variation in hardness can be due to minor variations in the local chemistry and microstructure of the plate since even homogenous armors are not absolutely uniform. Small variations in hardness measures also can result from errors in measuring the diameter of the indenter impression on the specimen. Given the expected variation of hardness measurements on any single specimen, BHN values often are provided as ranges, rather than as single discrete values.

As shown in Table 4, the highest Brinell hardnesses measured for the samples were 624 and 587. Those particular as-hardened samples were austenitized at 1550° F. (843° C.) (BHN 624) or 1600° F. (871° C.) (BHN 587). One of the two samples was oil quenched (BHN 624), and the other was air-cooled, and only one of the two samples (BHN 624) was reheated prior to rolling to final gauge.

In general, it was observed that using a temper anneal tended to increase sample hardness, with a 300° F. (149° C.) tempering temperature resulting in the greater hardness increase at each austenitizing temperature. Also, it was observed that increasing the austenitizing temperature generally tended to decrease the final hardness achieved. These correlations are illustrated in FIG. 1, which plots average $HR_C$ hardness as a function of austenitizing temperature for 0.275 inch (7 mm) samples (left panel) and 0.310 inch (7.8 mm) samples (right panel) in the as-hardened state ("AgeN") or after tempering at either 250° F. (121° C.) ("Age25") or 300° F. (149° C.) ("Age30").

Figure 2:
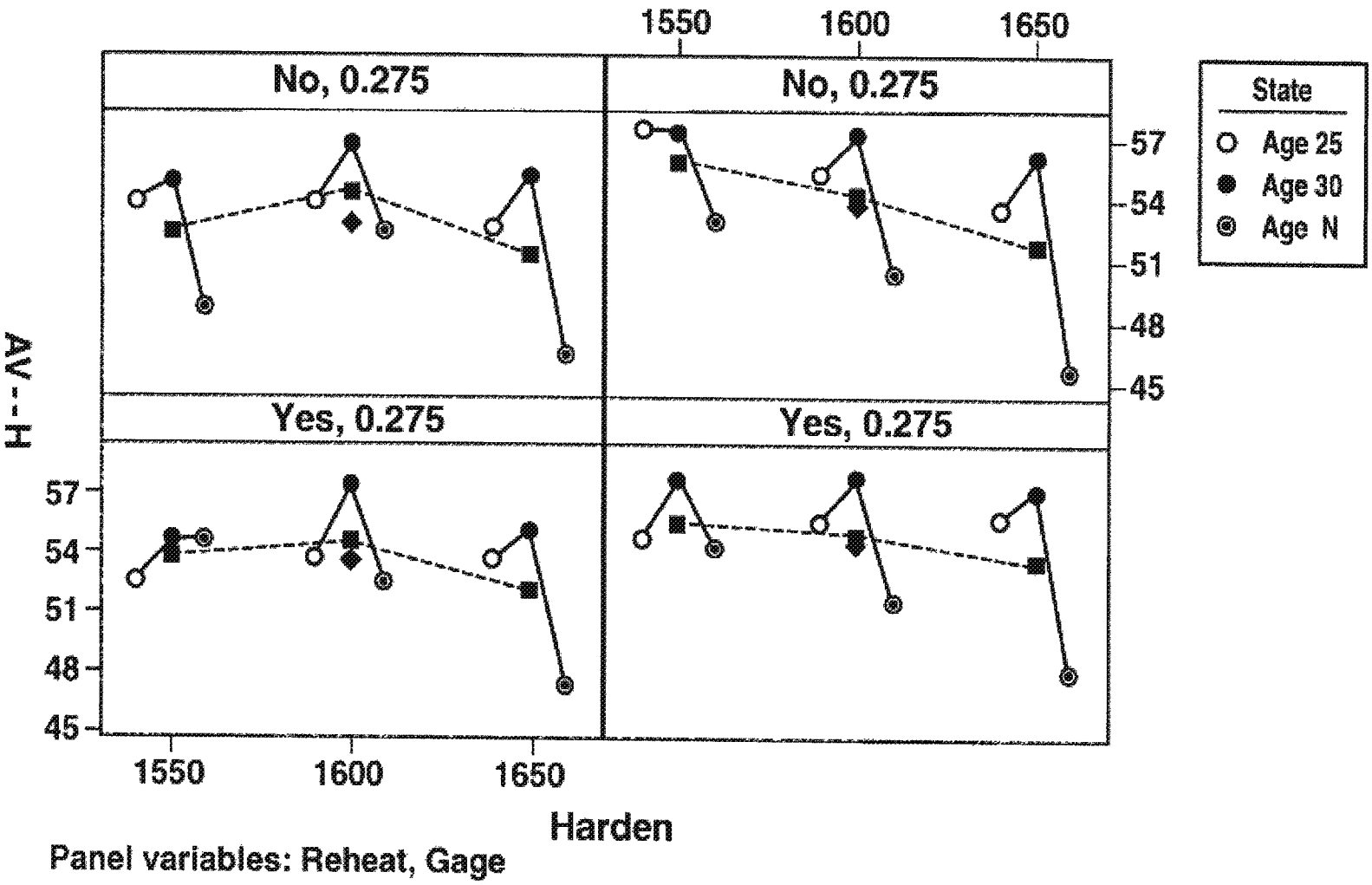
FIG. 2 is a plot of HRC hardness as a function of austenitizing treatment heating temperature for certain non-limiting experimental plate samples processed as described hereinbelow.
Figure 3:
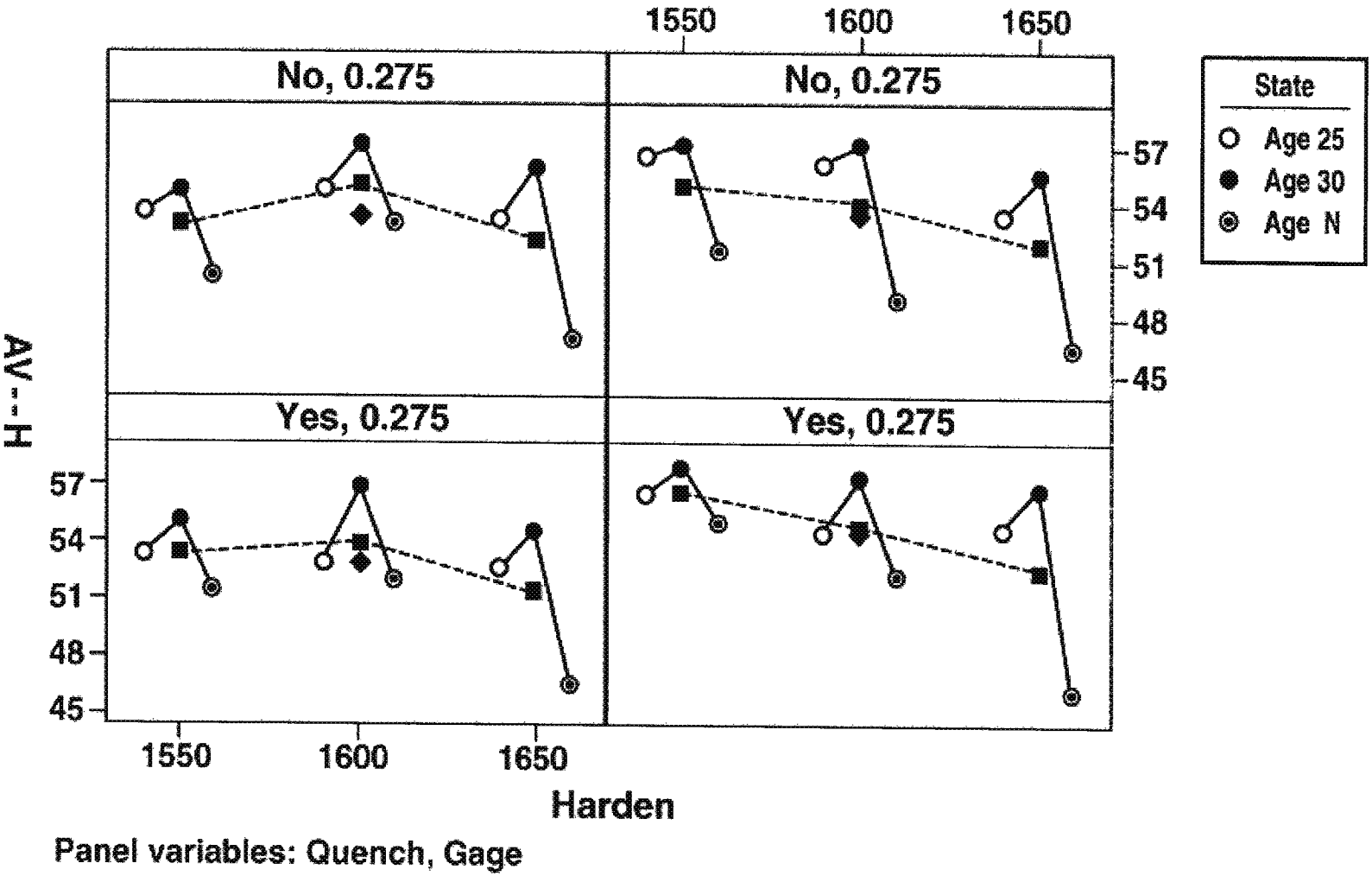
FIG. 3 is a plot of HRC hardness as a function of austenitizing treatment heating temperature for certain non-limiting experimental plate samples processed as described hereinbelow.

FIGS. 2 and 3 consider the effects on hardness of quench type and whether the re-slabs were reheated prior to rolling to 0.275 and 0.310 inch (7 and 7.8 mm) nominal final gauge. FIG. 2 plots $HR_C$ hardness as a function of austenitizing temperature for non-reheated 0.275 inch (7 mm) samples (upper left panel), reheated 0.275 inch (7 mm) samples (lower left panel), non-reheated 0.310 inch (7.8 mm) samples (upper right panel), and reheated 0.310 inch (7.8 mm) samples (lower right panel) in the as-hardened state ("AgeN") or after tempering at either 250° F. (121° C.) ("Age25") or 300° F. (149° C.) ("Age30"). Similarly, FIG. 3 plots $HR_C$ hardness as a function of austenitizing temperature for air-cooled 0.275 inch (7 mm) samples (upper left panel), oil-quenched 0.275 inch (7 mm) samples (lower left panel), air-cooled 0.310 inch (7.8 mm) samples (upper right panel), and oil-quenched 0.310 inch (7.8 mm) samples (lower right panel) in the as-hardened state ("AgeN") or after tempering at either 250° F. (121° C.) ("Age25") or 300° F. (149° C.) ("Age30"). The average hardness of samples processed at each of the austenitizing temperatures and satisfying the conditions pertinent to each of the panels in FIGS. 2 and 3 is plotted in each panel as a square-shaped data point, and each such data point in each panel is connected by dotted lines so as to better visualize any trend. The overall average hardness of all samples considered in each panel of FIGS. 2 and 3 is plotted in each panel as a diamond-shaped data point.

With reference to FIG. 2, it was generally observed that the hardness effect of reheating prior to rolling to final gauge was minor and not evident relative to the effect of other variables. For example, only one of the samples with the highest two Brinell hardnesses had been reheated prior to rolling to final gauge. With reference to FIG. 3, it was generally observed that any hardness difference resulting from using an air cool versus an oil quench after the austenitizing heat treatment was minimal. For example, only one of the samples with the highest two Brinell hardnesses had been reheated in plate form prior to rolling to final gauge.

It was determined that the experimental alloy samples included a high concentration of retained austenite after the austenitizing anneals. Greater plate thickness and higher austenitizing treatment temperatures tended to produce greater retained austenite levels. Also, it was observed that at least some portion of the austenite transformed to martensite during the temper annealing. Any untempered martensite present after the temper annealing treatment may lower the toughness of the final material. To better ensure optimum toughness, it was concluded that an additional temper anneal could be used to further convert any retained austenite to martensite. Based on the inventors' observations, an austenitizing temperature of at least about 1500° F. (815° C.), and more preferably at least about 1550° F. (843° C.), appears to be satisfactory for the articles evaluated in terms of achieving high hardnesses.

3. Ballistic Performance Testing

Several 18×18 inch (45.7×45.7 cm) test panels having a nominal thickness of 0.275 inch (7 mm) were prepared as described in Section 1 above, and then further processed as discussed below. The panels were then subjected to ballistic performance testing as described below.

Eight test panels produced as described in Section 1 were further processed as follows. The eight panels were austenitized at 1600° F. (871° C.) for 35 minutes (+/−5 minutes), allowed to air cool to room temperature, and hardness tested. The BHN hardness of one of the eight panels austenitized at 1600° F. (871° C.) was determined after air cooling in the as-austenitized, un-tempered ("as-hardened") condition. The as-hardened panel exhibited a hardness of about 600 BHN.

Six of the eight panels austenitized at 1600° F. (871° C.) and air cooled were divided into three sets of two, and each set was tempered at one of 250° F. (121° C.), 300° F. (149° C.), and 350° F. (177° C.) for 90 minutes (+/−5 minutes), air cooled to room temperature, and hardness tested. One panel of each of the three sets of tempered panels (three panels total) was set aside, and the remaining three tempered panels were re-tempered at their original 250° F. (121° C.), 300° F. (149° C.), or 350° F. (177° C.) tempering temperature for 90 minutes (+/−5 minutes), air cooled to room temperature, and hardness tested. These six panels are identified in Table 6 below by samples ID numbers 1 through 6.

One of the eight panels austenitized at 1600° F. (871° C.) and air cooled was immersed in 32° F. (0° C.) ice water for approximately 15 minutes and then removed and hardness tested. The panel was then tempered at 300° F. (149° C.) for 90 minutes (+/−5 minutes), air cooled to room temperature, immersed in 32° F. (0° C.) ice water for approximately 15 minutes, and then removed and hardness tested. The sample was then re-tempered at 300° F. (149° C.) for 90 minutes (+/−5 minutes), air cooled to room temperature, again placed in 32° F. (0° C.) ice water for approximately 15 minutes, and then again removed and hardness tested. This panel is referenced in Table 6 by ID number 7.

Three additional test panels prepared as described in Section 1 above were further processed as follows and then subjected to ballistic performance testing. Each of the three panels was austenitized at 1950° F. (1065° C.) for 35 minutes (+/−5 minutes), allowed to air cool to room temperature, and hardness tested. Each of the three panels was next tempered at 300° F. for 90 minutes (+/−5 minutes), air cooled to room temperature, and hardness tested. Two of three tempered, air-cooled panels were then re-tempered at 300° F. (149° C.) for 90 minutes (+/−5 minutes), air cooled, and then tested for hardness. One of the re-tempered panels was next cryogenically cooled to −120° F. (−84° C.), allowed to warm to room temperature, and hardness tested. These three panels are identified by ID numbers 9-11 in Table 6.

The eleven panels identified in Table 6 were individually evaluated for ballistic performance by assessing $V_{50}$ ballistic limit (protection) using 7.62 mm (.30 caliber M2, AP) projectiles as per MIL-DTL-46100E. The $V_{50}$ ballistic limit value is the calculated projectile velocity at which the probability is 50% that the projectile will penetrate the armor test panel.

More precisely, under U.S. Military Specifications MIL-DTL-46100E ("Armor, Plate, Steel, Wrought, High Hardness"), MIL-A-46099C ("Armor Plate, Steel, Roll-Bonded, Dual Hardness (0.187 Inches To 0.700 Inches Inclusive")), and MIL-DTL-32332 ("Armor Plate, Steel, Wrought, Ultra-high-hardness"), the $V_{50}$ ballistic limit (protection) value is the average velocity of six fair impact velocities comprising the three lowest projectile velocities resulting in complete penetration and the three highest projectile velocities resulting in partial penetration. A maximum spread of 150 feet-per-second (fps) is permitted between the lowest and highest velocities employed in determining $V_{50}$ ballistic limit values.

In cases where the lowest complete penetration velocity is lower than the highest partial penetration velocity by more than 150 fps, the ballistic limit is based on ten velocities (the five lowest velocities that result in complete penetration and the five highest velocities that result in partial penetrations). When the ten-round excessive spread ballistic limit is used, the velocity spread must be reduced to the lowest partial level, and as close to 150 fps as possible. The normal up and down firing method is used in determining $V_{50}$ ballistic limit (protection) values, all velocities being corrected to striking velocity. If the computed $V_{50}$ ballistic limit value is less than 30 fps above the minimum required and if a gap (high partial penetration velocity below the low complete penetration velocity) of 30 fps or more exists, projectile firing is continued as needed to reduce the gap to 25 fps or less.

The $V_{50}$ ballistic limit value determined for a test panel may be compared with the required minimum $V_{50}$ ballistic limit value for the particular thickness of the test panel. If the calculated $V_{50}$ ballistic limit value for the test panel exceeds the required minimum $V_{50}$ ballistic limit value, then it may be said that the test panel has "passed" the requisite ballistic performance criteria. Minimum $V_{50}$ ballistic limit values for plate armor are set out in various U.S. military specifications, including MIL-DTL-46100E, MIL-A-46099C, and MIL-DTL-32332.

Table 6 lists the following information for each of the eleven ballistic test panels: sample ID number; austenitizing temperature; BHN hardness after cooling to room temperature from the austenitizing treatment ("as-hardened"); tempering treatment parameters (if used); BHN hardness after cooling to room temperature from the tempering temperature; re-tempering treatment parameters (if used); BHN hardness after cooling to room temperature from the re-tempering temperature; and the difference in fps between the panel's calculated $V_{50}$ ballistic limit value and the required minimum $V_{50}$ ballistic limit value as per MIL-DTL-46100E and as per MIL-A-46099C. Positive $V_{50}$ difference values in Table 6 (e.g., "+419") indicate that the calculated $V_{50}$ ballistic limit for a panel exceeded the required $V_{50}$ by the indicated extent. Negative difference values (e.g., "−44") indicate that the calculated $V_{50}$ ballistic limit value for the panel was less than the required $V_{50}$ ballistic limit value per the indicated military specification by the indicated extent.

TABLE 6

| ID | Aus. Temp. (° F.) | As-Hardened Hardness (BHN) | Temper (minutes @ ° F.) | Post-Temper Hardness (BHN) | Re-Temper (minutes @ ° F.) | Post Re-Temper Hardness (BHN) | Re-Temper (minutes @ ° F.) | Post Re-Temper Hardness (BHN) | $V_{50}$ versus 46100E (fps) | $V_{50}$ versus 46099C (fps) |
|---|---|---|---|---|---|---|---|---|---|---|
| 1 | 1600 | 600 | 90@250 | 600 | NA | NA | NA | NA | +419 | +37 |
| 2 | 1600 | 600 | 90@250 | 600 | 90@250 | 600 | NA | NA | +341 | −44 |
| 3 | 1600 | 600 | 90@300 | 600 | NA | NA | NA | NA | +309 | −74 |
| 4 | 1600 | 600 | 90@300 | 600 | 90@300 | 600 | NA | NA | +346 | −38 |
| 5 | 1600 | 600 | 90@350 | 578 | NA | NA | NA | NA | +231 | −153 |
| 6 | 1600 | 600 | 90@350 | 578 | 90@350 | 578 | NA | NA | +240 | −144 |
| 7 | 1600 | 600 | 15@32 | 600 | 90@300 + AC + 15@32 | 600 | 90@300 + AC + 15@32 | 600 | +372 | −16 |
| 8 | 1950 | 555 | 90@300 | 555 | NA | NA | NA | NA | +243 | −137 |
| 9 | 1950 | 555 | 90@300 | 555 | 90@300 | 555 | NA | NA | +234 | −147 |
| 10 | 1950 | 555 | 90@300 | — | 90@300 | — | −120 | — | — | — |

Eight additional 18×18 inch (45.7×45.7 cm) (nominal) test panels, numbered 12-19, composed of the experimental alloy were prepared as described in Section 1 above. Each of the panels was nominally either 0.275 inch (7 mm) or 0.320 inch (7.8 mm) in thickness. Each of the eight panels was subjected to an austenitizing treatment by heating at 1600° F. (871° C.) for 35 minutes (+/−5 minutes) and then air cooled to room temperature. Panel 12 was evaluated for ballistic performance in the as-hardened state (as-cooled, with no temper treatment) against 7.62 mm (.30 caliber) M2, AP projectiles. Panels 13-19 were subjected to the individual tempering steps listed in Table 7, air cooled to room temperature, and then evaluated for ballistic performance in the same way as panels 1-11 above. Each of the tempering times listed in Table 7 are approximations and were actually within +/−5 minutes of the listed durations. Table 8 lists the calculated $V_{50}$ ballistic limit (performance) values of each of test panels 12-19, along with the required minimum $V_{50}$ ballistic limit value as per MIL-DTL-46100E and as per MIL-A-46099C for the particular panel thickness listed in Table 7.

TABLE 7

| ID | Gauge (inch) | No Temper | Temper @ 175° F. for 60 minutes | Temper @ 200° F. for 60 minutes | Temper @ 225° F. for 60 minutes | Temper @ 250° F. for 30 minutes | Temper @ 250° F. for 60 minutes | Temper @ 250° F. for 90 minutes | Temper @ 250° F. for 120 minutes |
|---|---|---|---|---|---|---|---|---|---|
| 12 | 0.282 | X | | | | | | | |
| 13 | 0.280 | | X | | | | | | |
| 14 | 0.281 | | | X | | | | | |
| 15 | 0.282 | | | | X | | | | |
| 16 | 0.278 | | | | | X | | | |
| 17 | 0.278 | | | | | | X | | |
| 18 | 0.285 | | | | | | | X | |
| 19 | 0.281 | | | | | | | | X |

TABLE 8

| Sample ID | Calculated $V_{50}$ Ballistic Limit (fps) | Min. $V_{50}$ Ballistic Limit per MIL-DTL-46100E (fps) | Min. $V_{50}$ Ballistic Limit per MIL-A-46099C (fps) |
|---|---|---|---|
| 12 | 2936 | 2426 | 2807 |
| 13 | 2978 | 2415 | 2796 |
| 14 | 3031 | 2421 | 2801 |
| 15 | 2969 | 2426 | 2807 |
| 16 | 2877 | 2403 | 2785 |
| 17 | 2915 | 2403 | 2785 |
| 18 | 2914 | 2443 | 2823 |
| 19 | 2918 | 2421 | 2801 |

Mill products in the forms of, for example, plate, bars, and sheet may be made from the alloys according to the present disclosure by processing including steps formulated with the foregoing observations and conclusions in mind in order to optimize hardness and ballistic performance of the alloy. As is understood by those having ordinary skill, a "plate" product has a nominal thickness of at least 3/16 inch and a width of at least 10 inches, and a "sheet" product has a nominal thickness no greater than 3/16 inch and a width of at least 10 inches. Persons having ordinary skill will readily understand the differences between the various conventional mill products, such as plate, sheet, and bar.

4. Cooling Tests a. Trial 1

Groups of 0.275×18×18 inch samples having the actual chemistry shown in Table 2 were processed through an austenitizing cycle by heating the samples at 1600±10° F. (871±6° C.) for 35 minutes±5 minutes, and were then cooled to room temperature using different methods to influence the cooling path. The cooled samples were then tempered for a defined time, and allowed to air cool to room temperature. The samples were Brinell hardness tested and ballistic tested. Ballistic $V_{50}$ values meeting the requirements under specification MIL-DTL-46100E were desired. Preferably, the ballistic performance as evaluated by ballistic $V_{50}$ values is no less 150 fps less than the $V_{50}$ values required under specification MIL-A-46099C. In general, MIL-A-46099C requires significantly higher $V_{50}$ values that are generally 300-400 fps greater than required under MIL-DTL-46100E.

Figure 4:
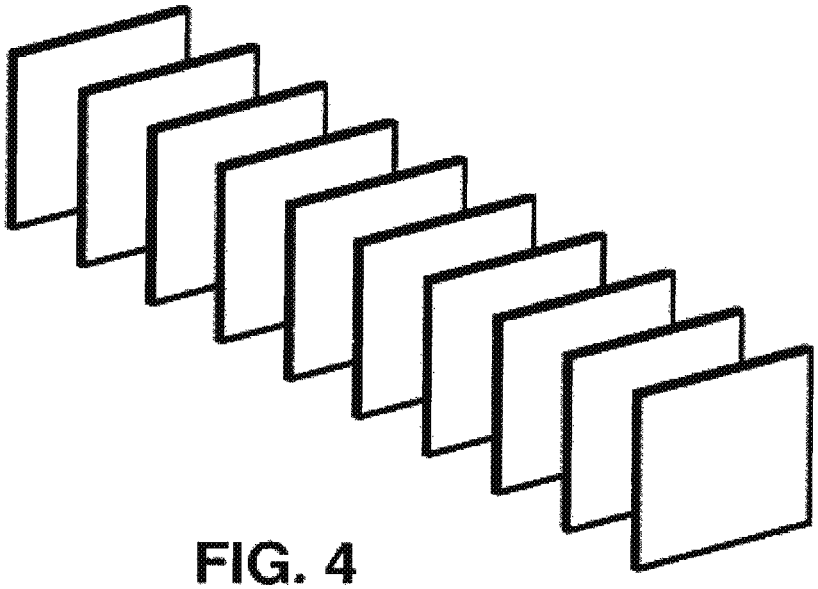
FIGS. 4, 5 and 7 are schematic representations of arrangements of test samples used during cooling from austenitizing temperature.

Table 9 lists hardness and $V_{50}$ results for samples cooled from the austenitizing temperature by vertically racking the samples on a cooling rack with 1 inch spacing between the samples and allowing the samples to cool to room temperature in still air in a room temperature environment. FIG. 4 schematically illustrates the stacking arrangement for these samples.

Table 10 provides hardness and $V_{50}$ values for samples cooled from the austenitizing temperature using the same general cooling conditions and the same vertical samples racking arrangement of the samples in Table 9, but wherein a cooling fan circulated room temperature air around the samples. Thus, the average rate at which the samples listed in Table 10 cooled from the austenitizing temperature exceeded that of the samples listed in Table 9.

Figure 5:
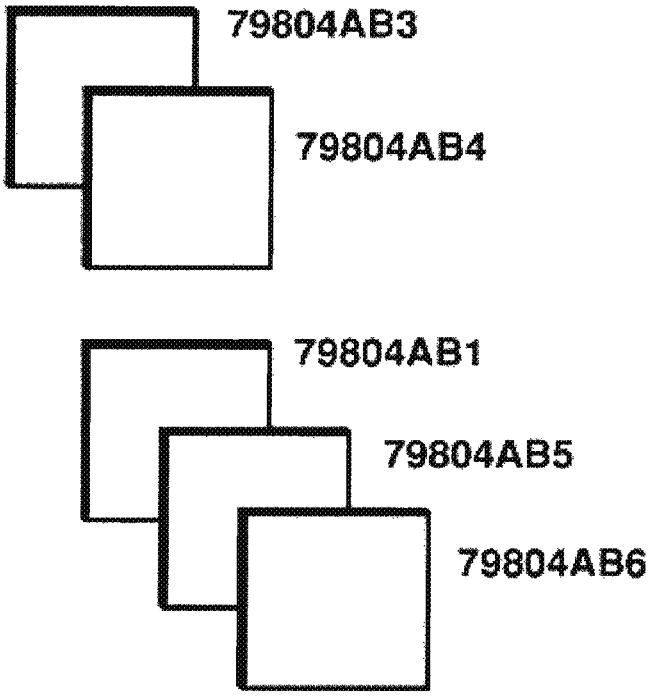
Figure 6:
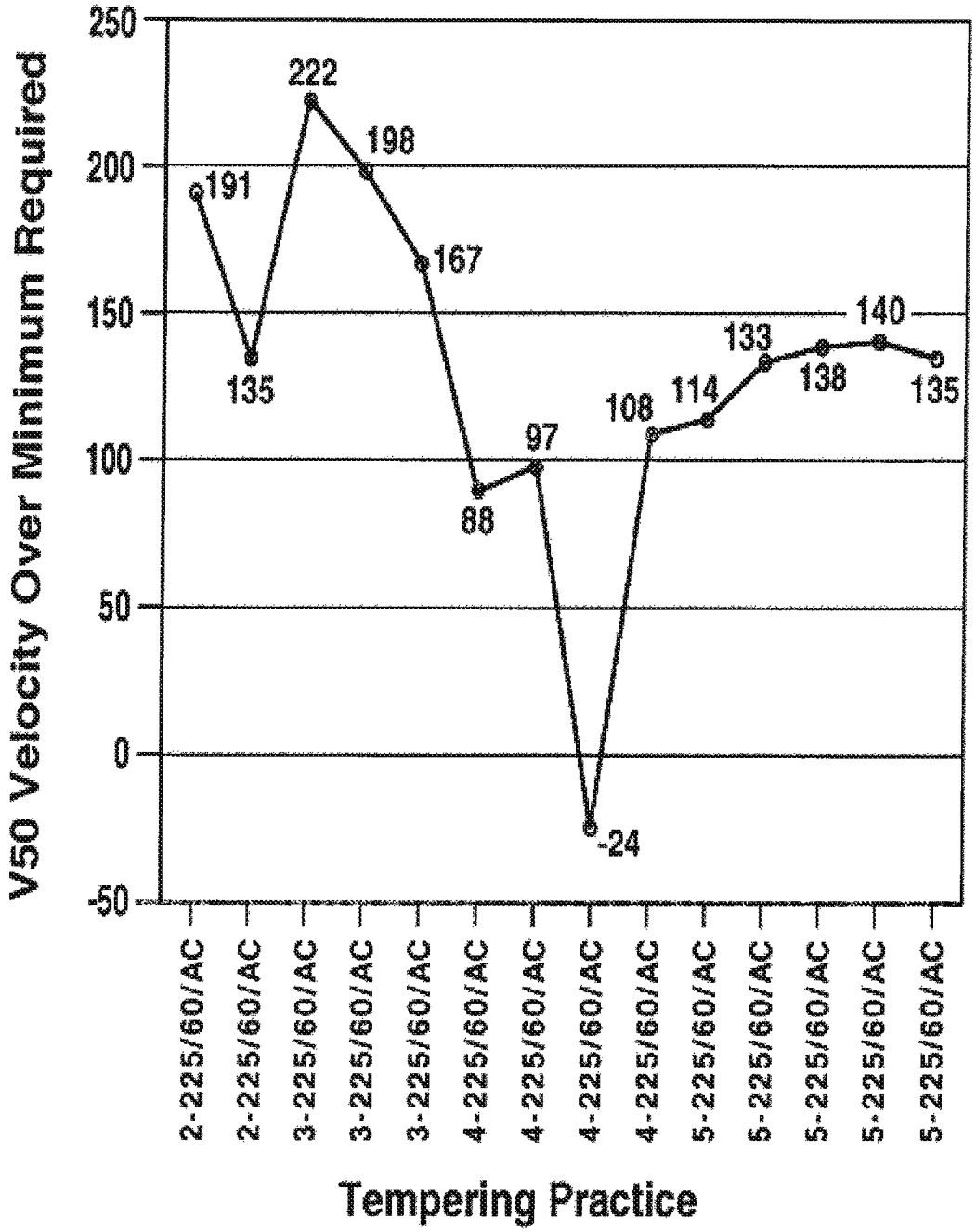
FIG. 6 is a plot of $V_{50}$ velocity over required minimum $V_{50}$ velocity (as per MIL-A-46099C) as a function of tempering practice for certain test samples.
Figure 7:
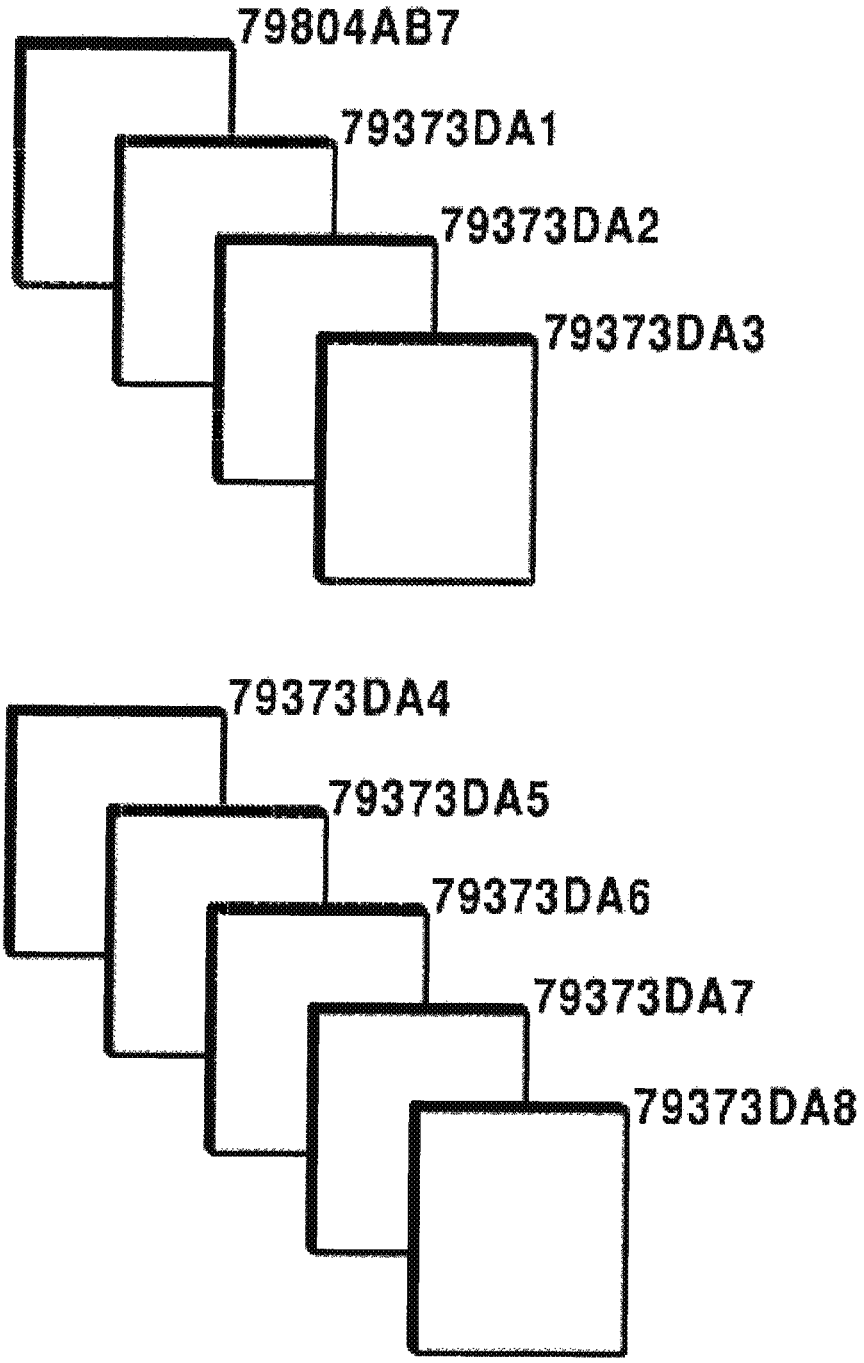
Figure 8:
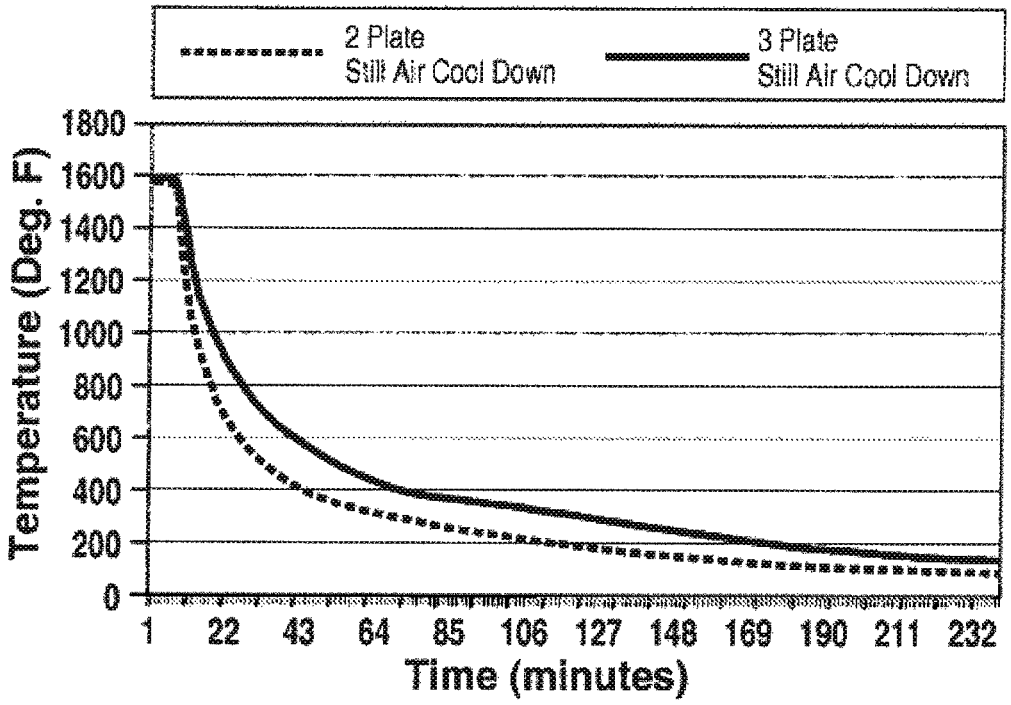
FIGS. 8 and 9 are plots of sample temperature over time during steps of cooling of certain test samples from an austenitizing temperature.
Figure 9:
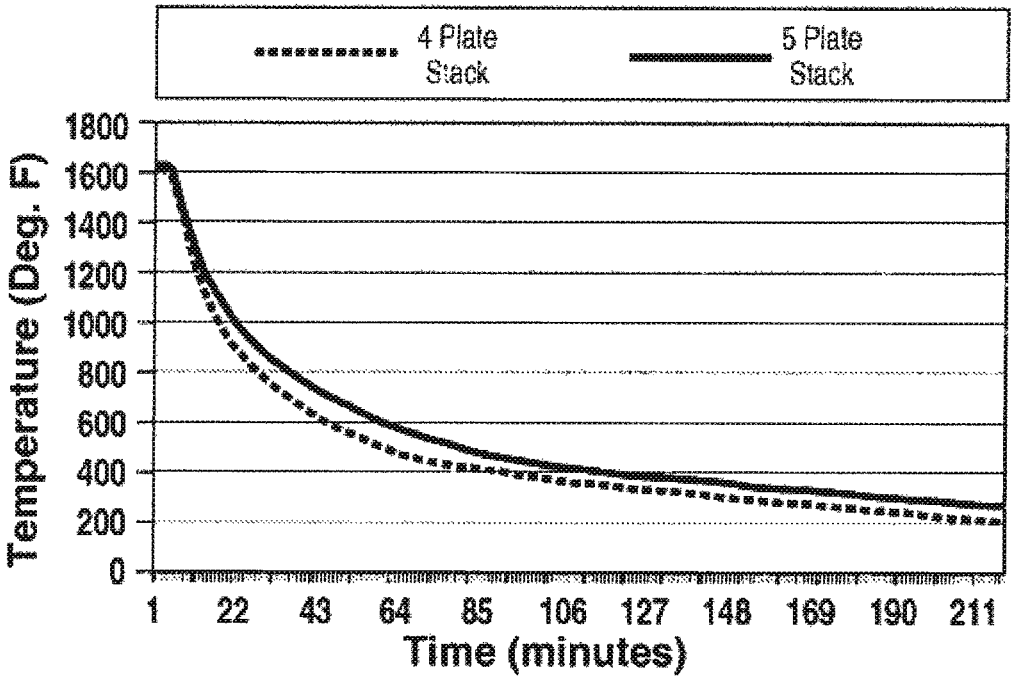

Table 11 lists hardnesses and $V_{50}$ results for still air-cooled samples arranged horizontally on the cooling rack and stacked in contact with adjacent samples so as to influence the rate at which the samples cooled from the austenitizing temperature. The $V_{50}$ values included in Table 11 are plotted as a function of tempering practice in FIG. 6. Four different stacking arrangements were used for the samples of Table 11. In one arrangement, shown on the top portion of FIG. 5, two samples were placed in contact with one another. In another arrangement, shown in the bottom portion of FIG. 5, three samples were placed in contact with one another. FIG. 8 is a plot of the cooling curves for the samples stacked as shown in the top and bottom portions of FIG. 5. FIG. 7 shows two additional stacking arrangements wherein either four plates (top portion) or five plates (bottom portion) were placed in contact with one another while cooling from the austenitizing temperature. FIG. 9 is a plot of the cooling curves for the samples stacked as shown in the top and bottom portions of FIG. 7.

For each sample listed in Table 11, the second column of the table indicates the total number of samples associated in the stacking arrangement. It is expected that circulating air around the samples (versus cooling in still air) and placing differing numbers of samples in contact with one another, as with the samples in Tables 9, 10, and 11, influenced the shape of the cooling curves for the various samples. In other words, it is expected that the particular paths followed by the cooling curves (i.e., the "shapes" of the curves) differed for the various arrangements of samples in Tables 9, 10, and 11.

For example, the cooling rate in one or more regions of the cooling curve for a sample cooled in contact with other samples may be less than the cooling rate for a vertically racked, spaced-apart sample in the same cooling curve region. It is believed that the differences in cooling of the samples resulted in microstructural differences in the samples that unexpectedly influenced the ballistic penetration resistance of the samples, as discussed below.

Tables 9-11 identify the tempering treatment used with each sample listed in those tables. The $V_{50}$ results in Tables 9-11 are listed as a difference in feet/second (fps) relative to the required minimum $V_{50}$ ballistic limit value for the particular test sample size under specification MIL-A-46099C. As examples, a value of "−156" means that the $V_{50}$ ballistic limit value for the sample, evaluated per the military specification using 7.62 mm (.30 caliber M2, AP) ammunition, was 156 fps less than the required value under the military specification, and a value of "+82" means that the $V_{50}$ ballistic limit value exceeded the required value by 82 fps. Thus, large, positive difference values are most desirable as they reflect ballistic penetration resistance that exceeds the required $V_{50}$ ballistic limit value under the military specification. The $V_{50}$ values reported in Table 9 were estimated since the target plates cracked (degraded) during the ballistic testing. Ballistic results of samples listed in Tables 9 and 10 experienced a higher incidence of cracking.

TABLE 9

Still Air Cooled, Samples Racked Vertically with 1 Inch Spacing

| Sample | Temper Treatment (° F. temp/time-at-temp/cooling) | $V_{50}$ (46099C) (fps) | Average Hardness after Austen. (BHN) | Average Hardness after Temper (BHN) |
|---|---|---|---|---|
| 79804AB1 | 200/60/AC | — | 712 | 712 |
| 79804AB2 | 200/60/AC + | — | 712 | 712 |
| | 350/60/AC | +3 | 712 | 640 |
| 79804AB3 | 200/60/AC | — | 712 | 704 |
| 79804AB4 | 200/60/AC | — | 712 | 712 |
| 79804AB5 | 225/60/AC | — | 712 | 712 |
| 79804AB6 | 225/60/AC | — | 712 | 704 |
| 79804AB7 | 225/60/AC | — | 712 | 712 |
| 79804AB8 | 400/60/AC | −155 | 712 | 608 |
| 79804AB9 | 500/60/AC | −61 | 712 | 601 |
| 79804AB10 | 600/60/AC | −142 | 712 | 601 |

TABLE 10

Fan Cooled, Samples Racked Vertically with 1 Inch Spacing

| Sample | Temper Treatment (° F. temp/time-at-temp/cooling) | $V_{50}$ (estimated) (46099C) (fps) | Average Hardness after Austen. (BHN) | Average Hardness after Temper (BHN) |
|---|---|---|---|---|
| 79373AB1 | 200/60/AC | −95 | 712 | 675 |
| 79373AB2 | 200/120/AC | −47 | 712 | 675 |
| 79373AB3 | 225/60/AC | +35 | 712 | 668 |
| 79373AB4 | 225/120/AC | −227 | 712 | 682 |
| 79373AB5 | 250/60/AC | +82 | 712 | 682 |
| 79373AB6 | 250/120/AC | +39 | 712 | 682 |
| 79373AB7 | 275/60/AC | +82 | 712 | 682 |
| 79373AB8 | 275/120/AC | +13 | 712 | 675 |
| 79373AB9 | 300/60/AC | −54 | 712 | 675 |

TABLE 11

Still Air Cooled, Stacked Samples

| Sample | Stacking (no. of sample plates) | Temper Treatment (° F. temp/time-at-temp/cooling) | $V_{50}$ (46099C) (fps) | Average Hardness after Austen. (BHN) | Average Hardness after Temper (BHN) |
|---|---|---|---|---|---|
| 79804AB3 | 2 | 225/60/AC | +191 | 653 | 653 |
| 79804AB4 | 2 | 225/60/AC | +135 | 653 | 653 |
| 79804AB1 | 3 | 225/60/AC | +222 | 640 | 627 |
| 79804AB5 | 3 | 225/60/AC | +198 | 640 | 640 |
| 79804AB6 | 3 | 225/60/AC | +167 | 627 | 627 |
| 79804AB7 | 4 | 225/60/AC | +88 | 646 | 646 |
| 79373DA1 | 4 | 225/60/AC | +97 | 601 | 601 |
| 79373DA2 | 4 | 225/60/AC | −24 | 601 | 601 |
| 79373DA3 | 4 | 225/60/AC | +108 | 620 | 607 |
| 79373DA4 | 5 | 225/60/AC | +114 | 627 | 614 |
| 79373DA5 | 5 | 225/60/AC | +133 | 627 | 601 |
| 79373DA6 | 5 | 225/60/AC | +138 | 620 | 601 |
| 79373DA7 | 5 | 225/60/AC | +140 | 620 | 614 |
| 79373DA8 | 5 | 225/60/AC | +145 | 614 | 621 |

Hardness values for the samples listed in Table 11 were significantly less than those for the samples of Tables 9 and 10. This difference was believed to be a result of placing samples in contact with one another when cooling the samples from the austenitizing temperature, which modified the cooling curve of the samples relative to the "air quenched" samples referenced in Tables 9 and 10 and FIG. 4. The slower cooling used for samples in Table 11 is also thought to act to auto-temper the material during the cooling from the austenitizing temperature to room temperature.

As discussed above, the conventional belief is that increasing the hardness of a steel armor enhances the ability of the armor to fracture impacting projectiles, and thereby should improve ballistic performance as evaluated, for example, by $V_{50}$ ballistic limit value testing. The samples in Tables 9 and 10 were compositionally identical to those in Table 11 and, with the exception of the manner of cooling from the austenitizing temperature, were processed in substantially the same manner. Therefore, persons having ordinary skill in the production of steel armor materials would expect that the reduced surface hardness of the samples in Table 11 would negatively impact ballistic penetration resistance and result in lower $V_{50}$ ballistic limit values relative to the samples in Tables 9 and 10.

Instead, the present inventors found that the samples of Table 11 unexpectedly demonstrated significantly improved penetration resistance, with a lower incidence of cracking while maintaining positive $V_{50}$ values. Considering the apparent improvement in ballistic properties in the experimental trials when tempering the steel after cooling from the austenitizing temperature, it is believed that in various embodiments of mill-scale runs it would be beneficial to temper at 250-450° F., and preferably at about 375° F., for about 1 hour after cooling from the austenitizing temperature.

The average $V_{50}$ ballistic limit value in Table 11 is 119.6 fps greater than the required $V_{50}$ ballistic limit value for the samples under MIL-A-46099C. Accordingly, the experimental data in Table 11 shows that embodiments of steel armors according to the present disclosure have $V_{50}$ velocities that approach or exceed the required values under MIL-A-46099C. In contrast, the average $V_{50}$ ballistic limit value listed in Table 10 for the samples cooled at a higher rate was only 2 fps greater than that required under the specification, and the samples experienced unacceptable multi-hit crack resistance. Given that the $V_{50}$ ballistic limit value requirements of MIL-A-46099C are approximately 300-400 fps greater than under specification MIL-DTL- 461000E, various steel armor embodiments according to the present disclosure will also approach or meet the required values under MIL-DTL-46100E. Although in no way limiting to the invention in the present disclosure, the $V_{50}$ ballistic limit values preferably are no less than 150 fps less than the required values under MIL-A-46099C. In other words, the $V_{50}$ ballistic limit values preferably are at least as great as a $V_{50}$ value 150 fps less than the required $V_{50}$ value under specification MIL-A-46099C with minimal crack propagation The average penetration resistance performance of the embodiments of Table 11 is substantial and is believed to be at least comparable to certain more costly high alloy armor materials, or K-12® dual hardness armor plate. In sum, although the steel armor samples in Table 11 had significantly lower surface hardness than the samples in Tables 9 and 10, they unexpectedly demonstrated substantially greater ballistic penetration resistance, with reduced incidence to crack propagation, which is comparable to ballistic resistance of certain premium, high alloy armor alloys.

Without intending to be bound by any particular theory, the inventors believe that the unique composition of the steel armors according to the present disclosure and the non-conventional approach to cooling the armors from the austenitizing temperature are important to providing the steel armors with unexpectedly high penetration resistance. The inventors observed that the substantial ballistic performance of the samples in Table 11 was not merely a function of the samples' lower hardness relative to the samples in Tables 9 and 10. In fact, as shown in Table 12 below, certain of the samples in Table 9 had post-temper hardness that was substantially the same as the post-temper hardness of samples in Table 11, but the samples in Table 11, which were cooled from austenitizing temperature differently than the samples in Tables 9 and 10, had substantially higher $V_{50}$ ballistic limit values with lower incidence of cracking. Therefore, without intending to be bound by any particular theory of operation, it is believed that the significant improvement in penetration resistance in Table 11 may have resulted from an unexpected and significant microstructural change that occurred during the unconventional manner of cooling and additionally permitted the material to become auto-tempered while cooling to room temperature.

Although in the present trials the cooling curve was modified from that of a conventional air quench step by placing the samples in contact with one another in a horizontal orientation on the cooling rack, based on the inventors' observations discussed herein it is believed that other means of modifying the conventional cooling curve may be used to beneficially influence the ballistic performance of the alloys according to the present disclosure. Examples of possible ways to beneficially modify the cooling curve of the alloys include cooling from the austenitizing temperature in a controlled cooling zone or covering the alloy with a thermally insulating material such as, for example, Kaowool material, during all or a portion of the step of cooling the alloy from the austenitizing temperature.

TABLE 12

| Table 9 - Selected Samples | | Table 11 - Selected Samples | |
|---|---|---|---|
| Avg. Hardness after Temper (BHN) | $V_{50}$ (46099C) (fps) | Avg. Hardness after Temper (BHN) | $V_{50}$ (46099C) (fps) |
| 640 | +3 | 640 | +198 |
| 608 | −155 | 607 | +108 |
| 601 | −61 | 601 | +97 |
| 601 | −142 | 601 | −24 |

TABLE 12-continued

| Table 9 - Selected Samples | | Table 11 - Selected Samples | |
|---|---|---|---|
| Avg. Hardness after Temper (BHN) | $V_{50}$ (46099C) (fps) | Avg. Hardness after Temper (BHN) | $V_{50}$ (46099C) (fps) |
| | | 601 | +133 |
| | | 601 | +138 |

In light of advantages obtained by high hardness in armor applications, low alloy steels according to the present disclosure may have hardness of at least 550 BHN, and in various embodiments at least 570 BHN or 600 BHN. Based on the foregoing test results and the present inventors' observation, steels according to the present invention may have hardness that is greater than 550 BHN and less than 700 BHN, and in various embodiments is greater than 550 or 570 BHN and less than 675. According to various other embodiments, steels according to the present disclosure have hardness that is at least 600 BHN and is less than 675 BHN. Hardness likely plays an important role in establishing ballistic performance. However, the experimental armor alloys produced according to the present methods also derive their unexpected substantial penetration resistance from microstructural changes resulting from the unconventional manner of cooling the samples, which modified the samples' cooling curves from a curve characterizing a conventional step of cooling samples from austenitizing temperature in air.

b. Trial 2

Figure 10:
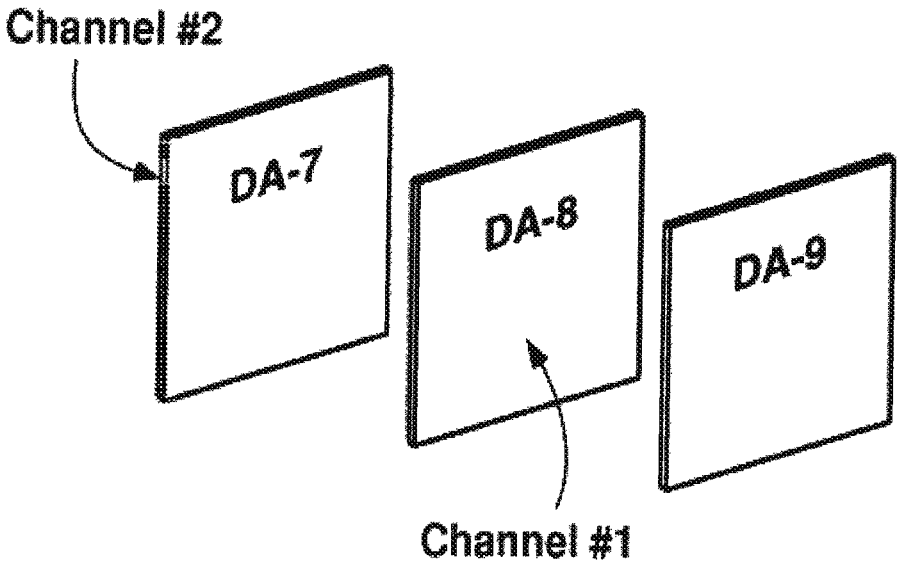
FIGS. 10 and 11 are schematic representations of arrangements of test samples used during cooling from austenitizing temperature.
Figure 11:
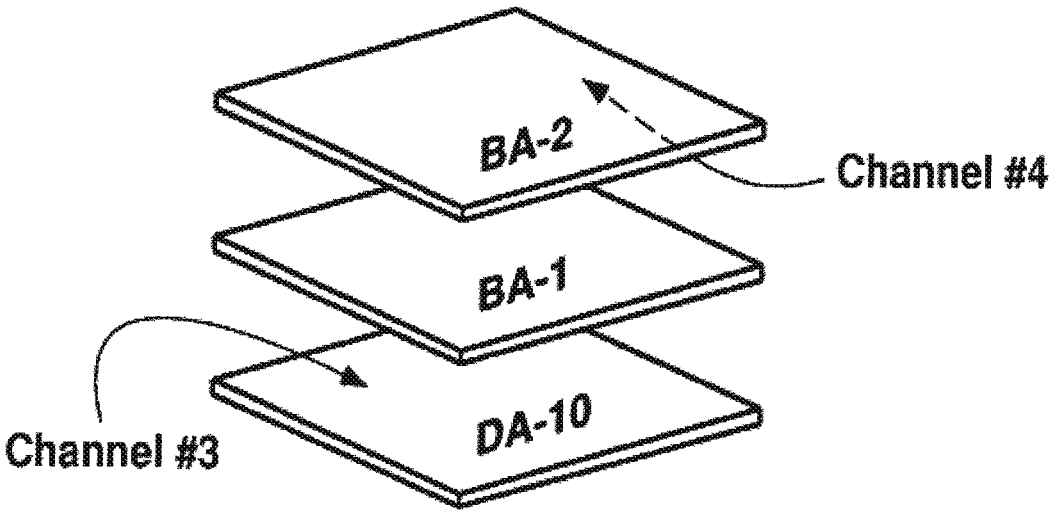

An experimental trial was conducted to investigate specific changes to the cooling curves of alloys cooled from the austenitizing temperature that may be at least partially responsible for the unexpected improvement in ballistic penetration resistance of alloys according to the present disclosure. Two groups of three 0.310 inch sample plates having the actual chemistry shown in Table 2 were heated to a 1600±10° F. (871±6° C.) austenitizing temperature for 35 minutes±5 minutes. The groups were organized on the furnace tray in two different arrangements to influence the cooling curve of the samples from the austenitizing temperature. In a first arrangement illustrated in FIG. 10, three samples (nos. DA-7, DA-8, and DA-9) were vertically racked with a minimum of 1 inch spacing between the samples. A first thermocouple (referred to as "channel 1") was positioned on the face of the middle sample (DA-8) of the racked samples. A second thermocouple (channel 2) was positioned on the outside face (i.e., not facing the middle plate) of an outer plate (DA-7). In a second arrangement, shown in FIG. 11, three samples were horizontally stacked in contact with one another, with sample no. DA-10 on the bottom, sample no. BA-2 on the top, and sample no. BA-1 in the middle. A first thermocouple (channel 3) was disposed on the top surface of the bottom sample, and a second thermocouple (channel 4) was disposed on the bottom surface of the top sample (opposite the top surface of the middle sample). After each arrangement of samples was heated to and held at the austenitizing temperature, the sample tray was removed from the furnace and allowed to cool in still air until the samples were below 300° F. (149° C.).

Hardness (BHN) was evaluated at corner locations of each sample after cooling the samples from the austenitizing temperature to room temperature, and again after each austenitized sample was tempered for 60 minutes at 225° F. (107° C.). Results are shown in Table 13.

TABLE 13

| Samples | Hardness (BHN) at Sample Corners after Cooling from Austenitizing Temperature | | | | Hardness (BHN) at Sample Corners after Tempering Treatment | | | |
|---|---|---|---|---|---|---|---|---|
| Vertically Stacked | | | | | | | | |
| DA-7 | 653 | 601 | 653 | 653 | 653 | 627 | 601 | 627 |
| DA-8 | 627 | 601 | 653 | 627 | 653 | 627 | 653 | 653 |
| DA-9 | 653 | 653 | 653 | 627 | 601 | 627 | 601 | 627 |
| Horizontally Stacked | | | | | | | | |
| DA-10 (bottom) | 653 | 653 | 627 | 627 | 653 | 627 | 601 | 653 |
| BA-1 (middle) | 653 | 653 | 653 | 653 | 682 | 682 | 653 | 653 |
| BA-2 (top) | 712 | 653 | 653 | 653 | 653 | 653 | 653 | 653 |

Figure 12:
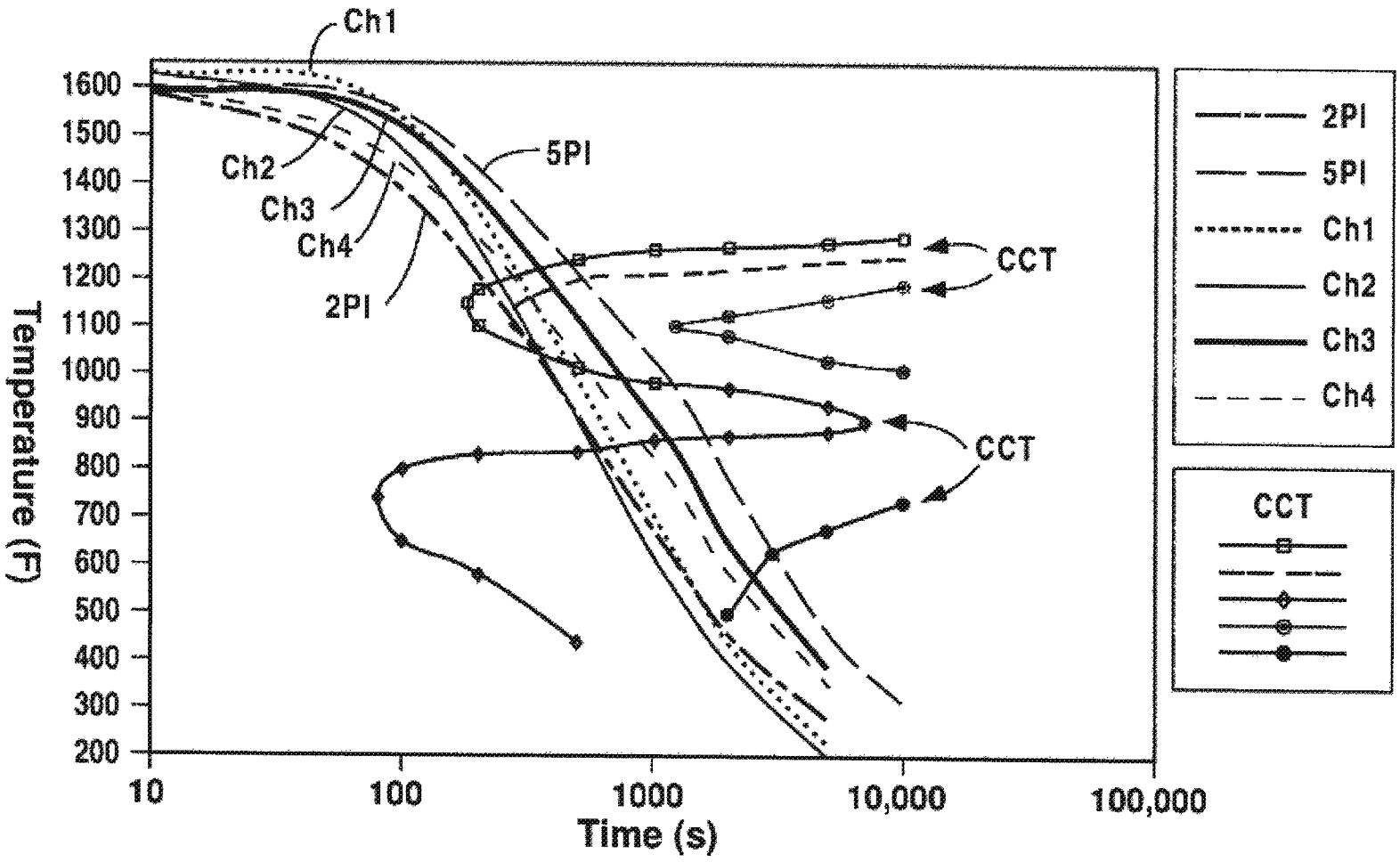
FIGS. 12-14 are graphs plotting sample temperature over time for several experimental samples cooled from austenitizing temperature, as discussed herein.
Figure 13:
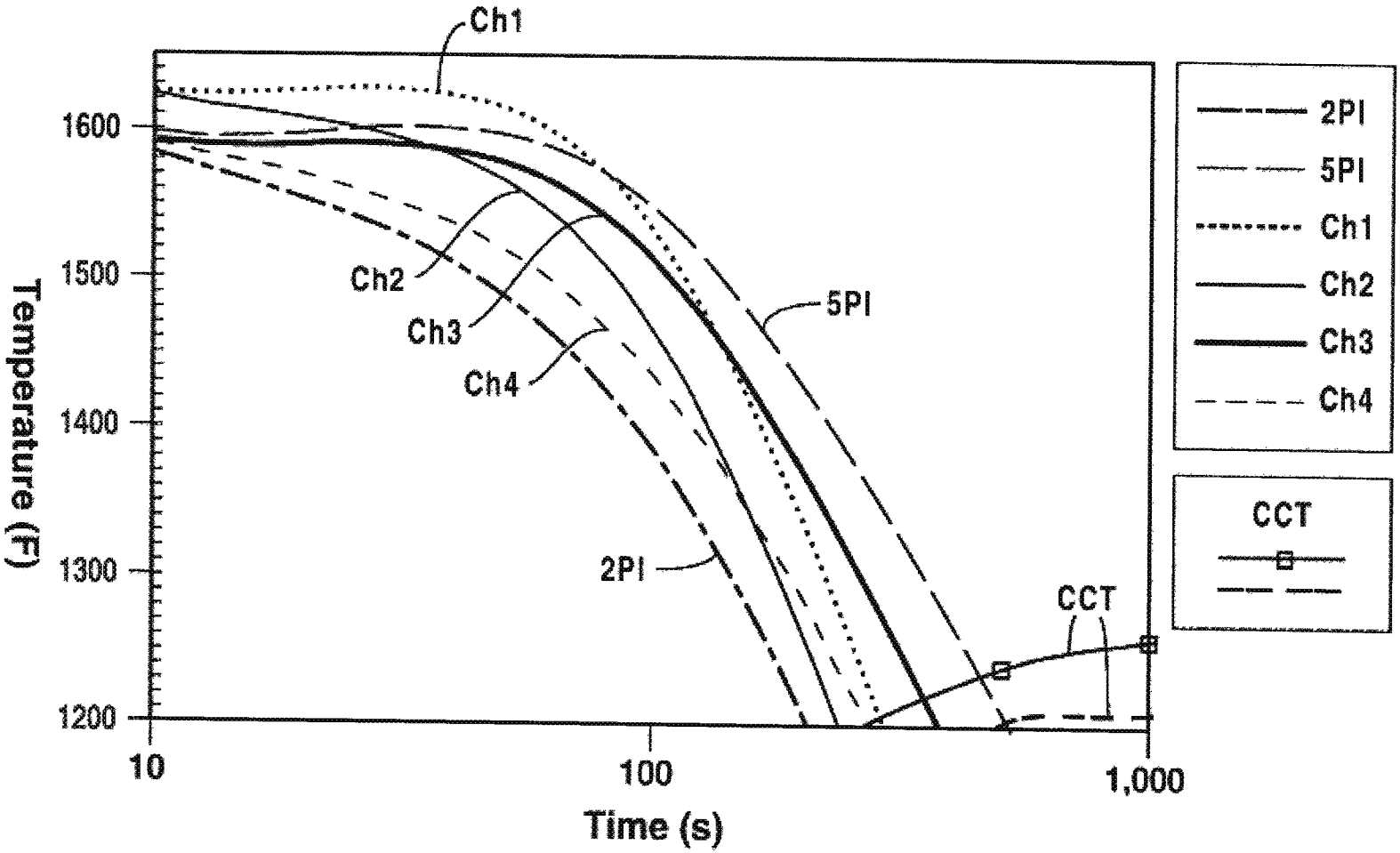
Figure 14:
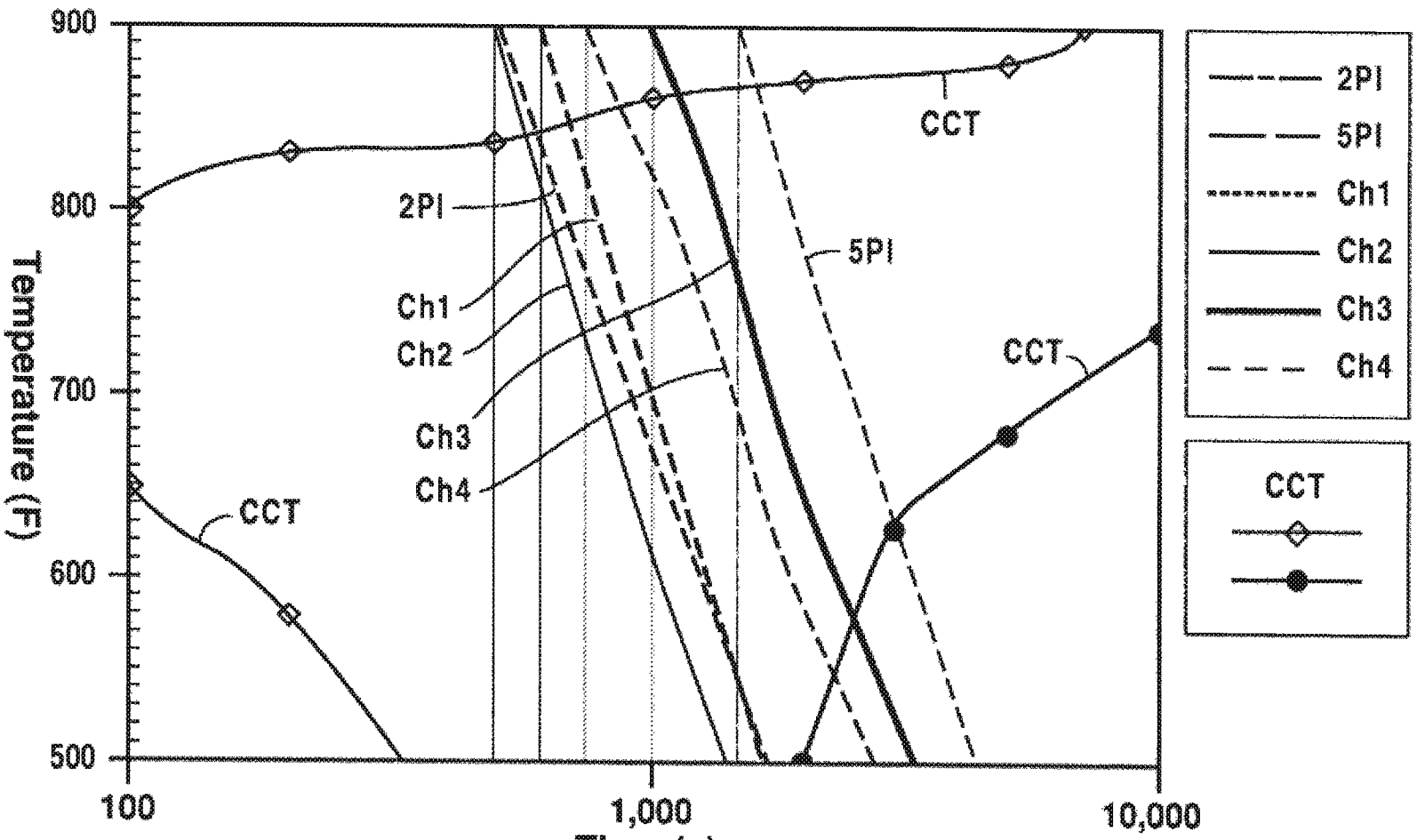
Figure 15:
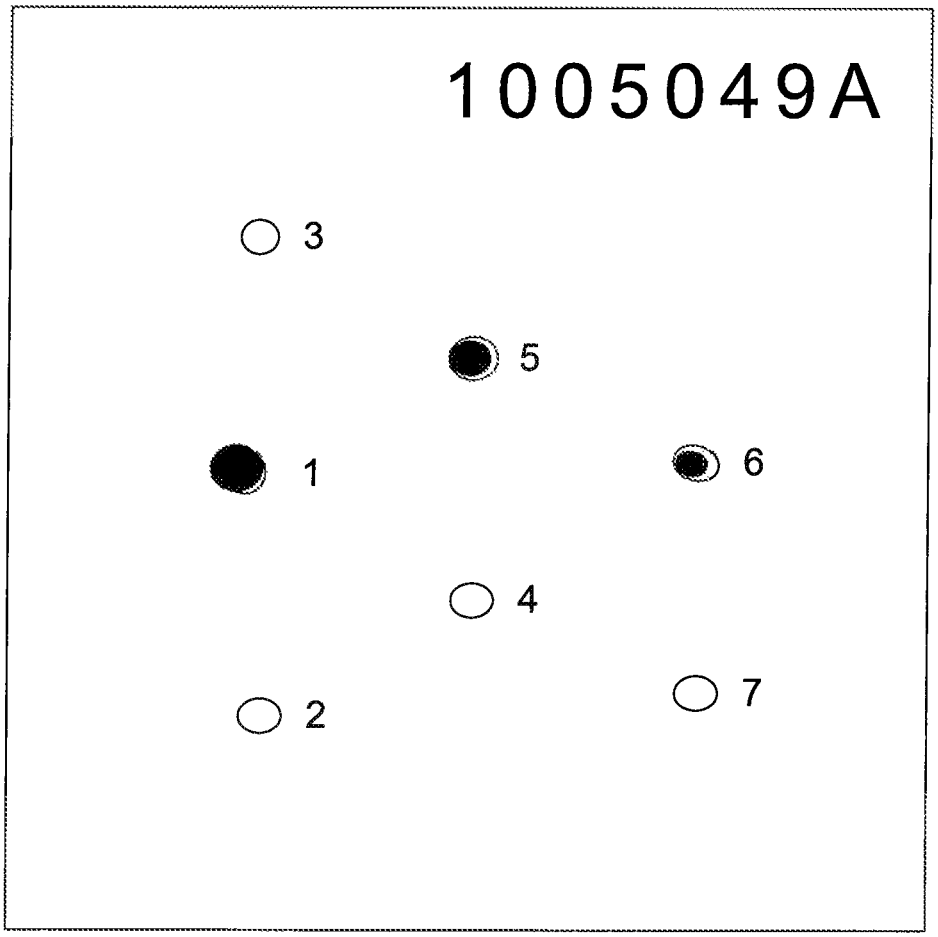
FIGS. 15-20 are photographs of ballistic test panels formed from a high hardness alloy disclosed and described herein.
Figure 16:
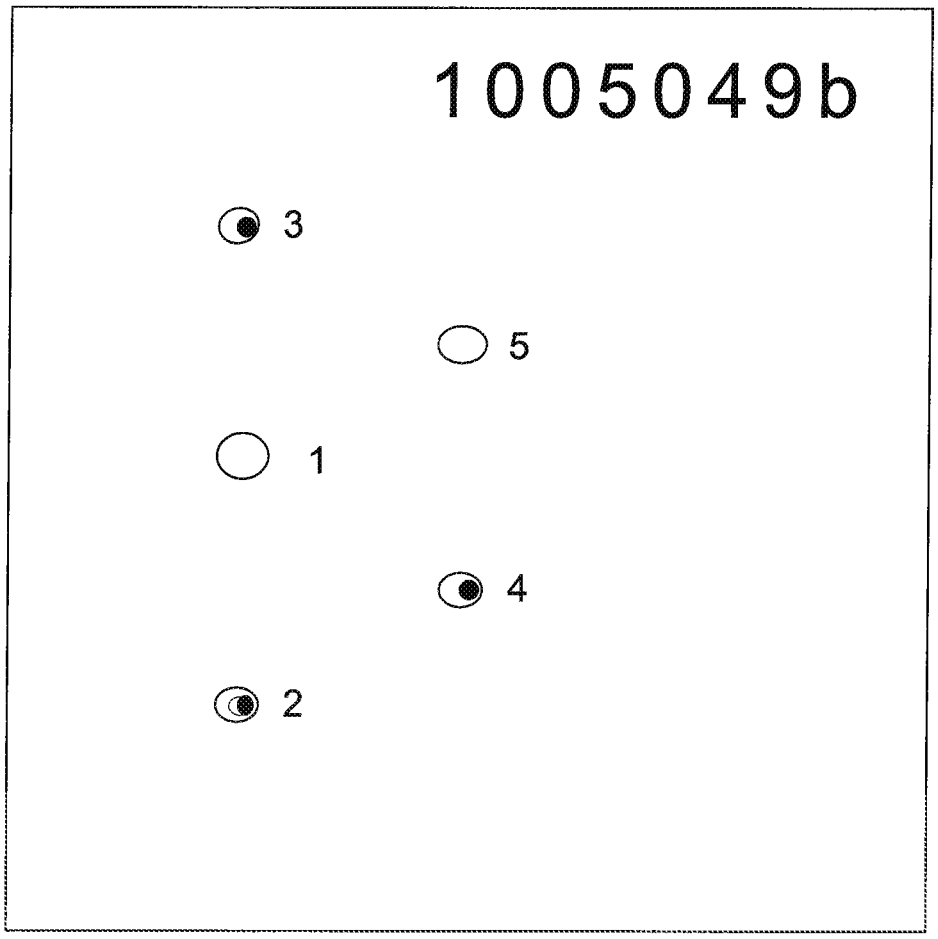
Figure 17:
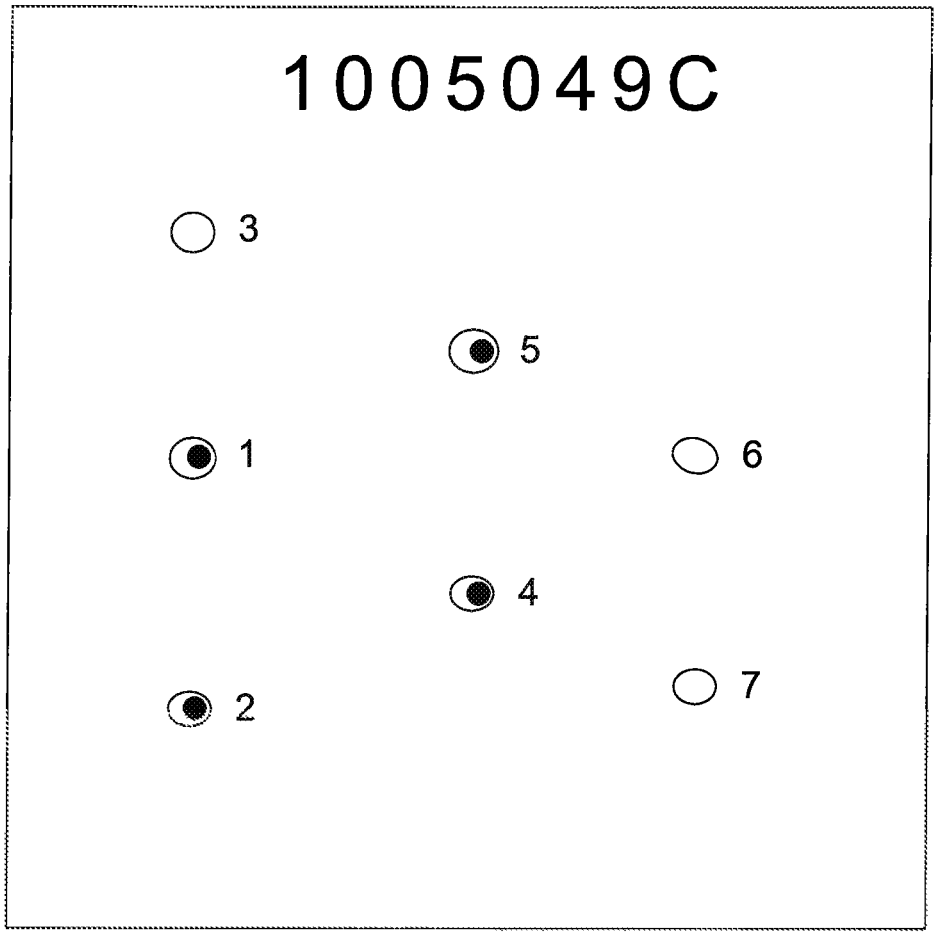
Figure 18:
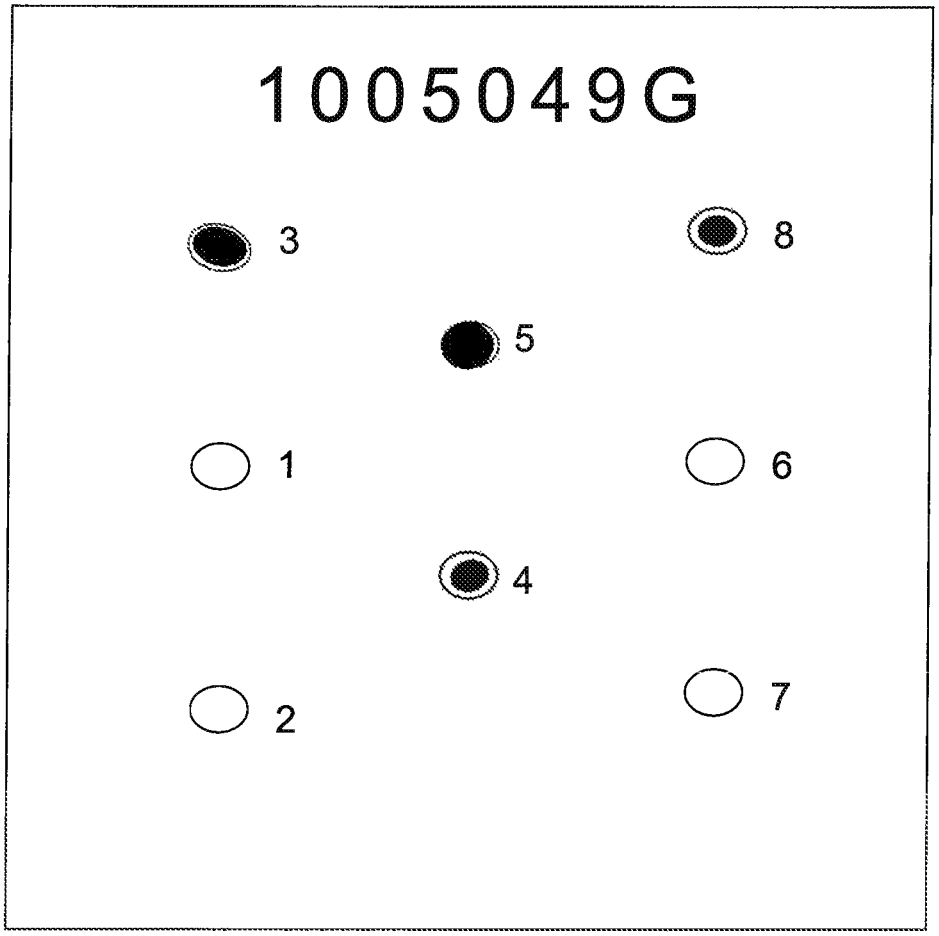
Figure 19:
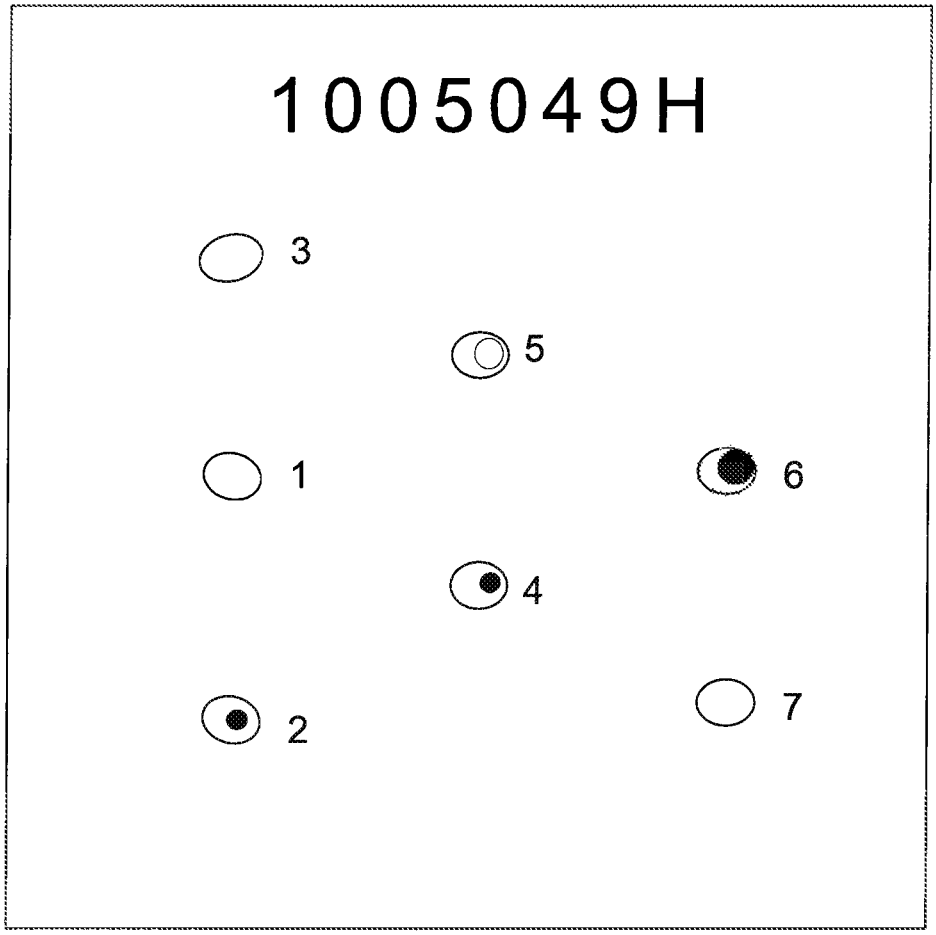
Figure 20:
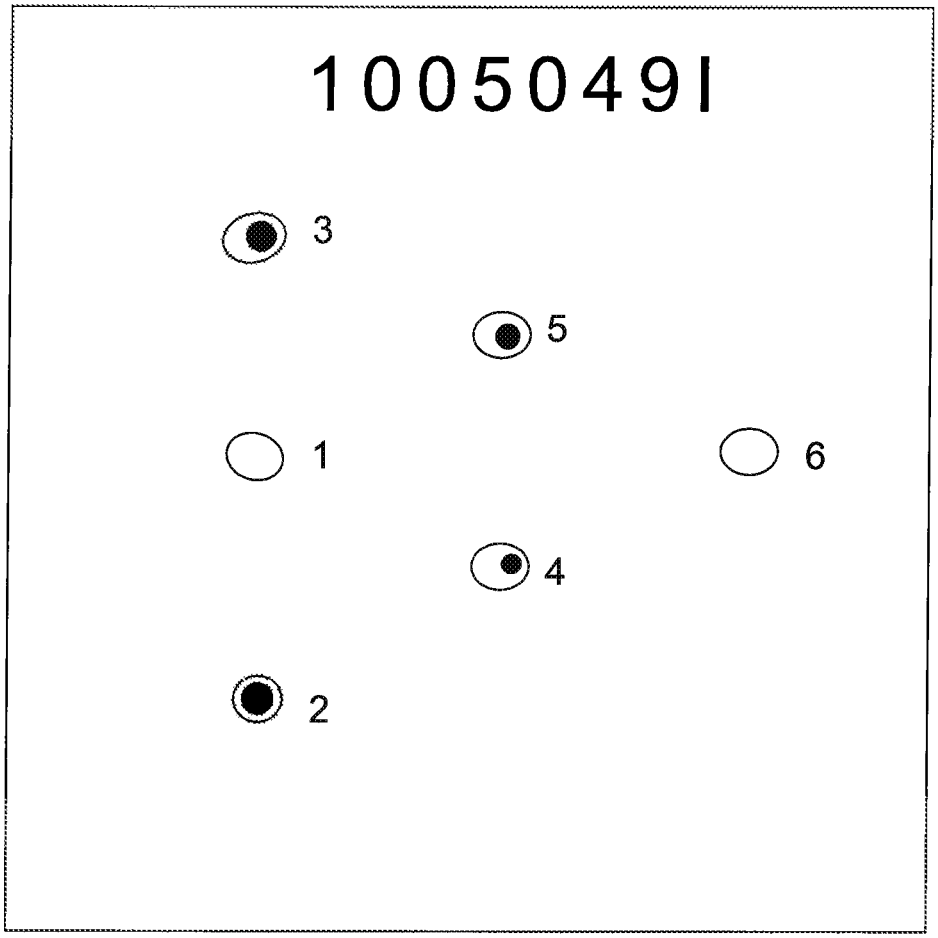

The cooling curve shown in FIG. 12 plots sample temperature recorded at each of channels 1-4 from a time just after the samples were removed from the austenitizing furnace until reaching a temperature in the range of about 200-400° F. (93-204° C.). FIG. 12 also shows a possible continuous cooling transformation (CCT) curve for the alloy, illustrating various phase regions for the alloy as it cools from high temperature. FIG. 13 shows a detailed view of a portion of the cooling curve of FIG. 11 including the region in which each of the cooling curves for channels 1-4 intersect the theoretical CCT curve. Likewise, FIG. 14 shows a portion of the cooling curve and CCT curves shown in FIG. 12, in the 500-900° F. (260-482° C.) sample temperature range. The cooling curves for channels 1 and 2 (the vertically racked samples) are similar to the curves for channels 3 and 4 (the stacked samples). However, the curves for channels 1 and 2 follow different paths than the curves for channels 3 and 4, and especially so in the early portion of the cooling curves (during the beginning of the cooling step).

Subsequently, the shapes of the curves for channels 1 and 2 reflect a faster cooling rate than for channels 3 and 4. For example, in the region of the cooling curve in which the individual channel cooling curves first intersect the CCT curve, the cooling rate for channels 1 and 2 (vertically racked samples) was approximately 136° F./min (75.6° C./min), and for channels 3 and 4 (stacked samples) were approximately 98° F./min (54.4° C./min) and approximately 107° F./min (59.4° C./min), respectively. As would be expected, the cooling rates for channels 3 and 4 fall between the cooling rates measured for the cooling trials involving two stacked plates (111° F./min (61.7° C./min)) and 5 stacked plates (95° F./min (52.8° C./min)), discussed above. The cooling curves for the two stacked plate ("2Pl") and 5 stacked plate ("5Pl") cooling trials also are shown in FIGS. 12-14.

The cooling curves shown in FIGS. 12-14 for channels 1-4 suggest that all of the cooling rates did not substantially differ. As shown in FIGS. 12 and 13, however, each of the curves initially intersects the CCT curve at different points, indicating different amounts of transition, which may significantly affect the relative microstructures of the samples. The variation in the point of intersection of the CCT curve is largely determined by the degree of cooling that occurs while the sample is at high temperature. Therefore, the amount of cooling that occurs in the time period relatively soon after the sample is removed from the furnace may significantly affect the final microstructure of the samples, and this may in turn provide or contribute to the unexpected improvement in ballistic penetration resistance discussed herein. Therefore, the experimental trial confirmed that the manner in which the samples are cooled from the austenitizing temperature could influence alloy microstructure, and this may be at least partially responsible for the improved ballistic performance of armor alloys according to the present disclosure.

5. Conventional Cooling and Tempering Tests

Ballistic test panels were prepared from an alloy having the experimental chemistry shown in Table 2 above. Alloy ingots were prepared by melting in an electric arc furnace and refined using AOD or AOD and ESR. Ingot surfaces were ground using conventional practices. The ingots were then heated to about 1300° F. (704° C.), equalized, held at this first temperature for 6 to 8 hours, heated at about 200° F./hour (93° C./hour) up to about 2050° F. (1121° C.), and held at the second temperature for about 30-40 minutes per inch of thickness. Ingots were then de-scaled and hot rolled to 6-7 inch slabs (15.2-17.8 cm). The slabs were hot sheared to form slabs having dimensions of about 6-7 inch thickness, 38-54 inch (96.5-137.2 cm) length, and 36 inch (91.4 cm) width.

The slabs were reheated to about 2050° F. (1121° C.) for 1-2 hours (time-at-temperature) before subsequent additional hot rolling to re-slabs of about 1.50-2.65 inches (3.81-6.73 cm) in thickness. The re-slabs were stress relief annealed using conventional practices. The re-slab surfaces were then blast cleaned and the edges and ends were ground.

The re-slabs were heated to about 1800° F. (982° C.) and held at temperature for 20 minutes per inch of thickness. The slabs were then finish rolled to long plates having finished gauge thicknesses ranging from about 0.188 inches (4.8 mm) to about 0.300 inch (7.6 mm).

The plates were then placed in a furnace to austenitize the constituent steel alloy by heating to a temperature in the range of 1450° F. to 1650° F. (±10° F.) for 60 minutes (±5 minutes), beginning when the surfaces of the plates reached within 10° F. of the austenitizing temperature. The plates were removed from the furnace after 60 minutes time-at-temperature and allowed to conventionally cool in still air to room temperature. After cooling to room temperature, the plates were shot blasted to clean and descale.

The plates were then tempered at a temperature in the range of 250° F. to 500° F. (±5° F.) for 450 minutes to 650 minutes (±5 minutes) time-at-temperature. The tempered plates were sectioned to 12-inch by 12-inch (30.5×30.5 cm) plates having various finished gauge thicknesses in the range 0.188-0.300 inches. Six (6) 12-inch by 12-inch plates were selected for hardness testing and ballistic penetration resistance testing. The BHN of each tempered plate was determined per ASTM E-10. The $V_{50}$ ballistic limit (protection) value for each plate was also determined per U.S. Military Specification (e.g., MIL-DTL-46100E, MIL-A-46099C, and MIL-DTL-32332) using .30 caliber M2, AP projectiles.

All six (6) plates were processed using generally identical methods except for the tempering temperatures and rolled finish gauges. The plate thicknesses, the tempering parameters, and the as-tempered BHN determined for each plate are provided in Table 14 and the results of the ballistic testing are provided in Table 15.

TABLE 14

| Plate | Nominal Gauge (inches) | Average Thickness (inches) | Tempering Temperature (° F.) | Time-at-temperature (minutes) | BHN |
|---|---|---|---|---|---|
| 1005049A | 0.188 | 0.192 | 350 | 480 | 578 |
| 1005049B | 0.236 | 0.240 | 350 | 480 | 601 |
| 1005049C | 0.250 | 0.254 | 350 | 480 | 601 |
| 1005049G | 0.188 | 0.195 | 335 | 480 | 578 |
| 1005049H | 0.236 | 0.237 | 335 | 480 | 601 |
| 1005049I | 0.250 | 0.252 | 335 | 480 | 601 |

TABLE 15

| Plate | Measured $V_{50}$ ballistic limit (fps) | Minimum $V_{50}$ ballistic limit per MIL-DTL-46100E (fps) | Minimum $V_{50}$ ballistic limit per MIL-A-46099C (fps) | Minimum $V_{50}$ ballistic limit per MIL-DTL-32332 (Class 1) (fps) | Minimum $V_{50}$ ballistic limit per MIL-DTL-32332 (Class 2) (fps) |
|---|---|---|---|---|---|
| 1005049A | 2246 | 1765 | 2280 | 2103 | 2303 |
| 1005049B | 2565 | 2162 | 2574 | 2445 | 2645 |
| 1005049C | 2613 | 2258 | 2653 | 2520 | 2720 |
| 1005049G | 2240 | 1793 | 2299 | 2129 | 2329 |
| 1005049H | 2562 | 2140 | 2557 | 2428 | 2628 |
| 1005049I | 2703 | 2245 | 2642 | 2510 | 2710 |

FIGS. 15-20 are photographs of plates 1005049A-C and 1005049G-I, respectively, taken after ballistic testing per U.S. Military Specification. As shown in the photographs, the plates did not exhibit any observable cracking or crack propagation resulting from the multiple .30 caliber AP projectile strikes. As indicated in Table 14, above, each of the plates exceeded 570 BHN, and four of the six plates exceeded 600 BHN.

Table 16 list the results of the ballistic testing as a difference between the measured $V_{50}$ ballistic limit value and the minimum $V_{50}$ ballistic limit value per U.S. Military Specification (MIL-DTL-46100E, MIL-A-46099C, and MIL-DTL-32332). For example, a value of "481" means that the $V_{50}$ value for that particular plate exceeded the minimum required $V_{50}$ limit value under the indicated U.S. Military Specification by 481 feet per second. A value of "−34" means that the $V_{50}$ value for that particular plate was 34 feet per second less than the minimum required $V_{50}$ limit value under the indicated U.S. Military Specification.

TABLE 16

| Plate | Measured $V_{50}$ ballistic limit (fps) | Difference Between Measured $V_{50}$ and Minimum $V_{50}$ per MIL-DTL-46100E (fps) | Difference Between Measured $V_{50}$ and Minimum $V_{50}$ per MIL-A-46099C (fps) | Difference Between Measured $V_{50}$ and Minimum $V_{50}$ per MIL-DTL-32332 (Class 1) (fps) | Difference Between Measured $V_{50}$ and Minimum $V_{50}$ per MIL-DTL-32332 (Class 2) (fps) |
|---|---|---|---|---|---|
| 1005049A | 2246 | 481 | −34 | 143 | −57 |
| 1005049B | 2565 | 403 | −9 | 120 | −80 |
| 1005049C | 2613 | 355 | −40 | 93 | −107 |
| 1005049G | 2240 | 447 | −59 | 111 | −89 |
| 1005049H | 2562 | 422 | 5 | 134 | −66 |
| 1005049I | 2703 | 458 | 61 | 193 | −7 |

As indicated in Table 16, each of the plates exceeded the minimum $V_{50}$ ballistic limit values per U.S. Military Specifications MIL-DTL-46100E and MIL-DTL-32332 (Class 1). Two of the six plates exceeded the minimum $V_{50}$ ballistic limit per MIL-A-46099C. Each of the plates exhibited a $V_{50}$ ballistic limit value that was at least as great as a $V_{50}$ ballistic limit value that is 150 fps less than the performance requirements under MIL-A-46099C and the Class 2 performance requirements under MIL-DTL-32332. Indeed, each of the plates exhibited a $V_{50}$ ballistic limit value that was at least as great as a $V_{50}$ ballistic limit value that is 60 fps less than the performance requirements under MIL-A-46099C and 110 fps less than the Class 2 performance requirements under MIL-DTL-32332.

The unexpected and surprising ballistic performance properties described above were achieved with near 600 BHN or over 600 BHN ultra-high hardness steel alloy plates that exhibited no observable cracking during the ballistic testing. These characteristics were achieved using austenitizing heat treatment, cooling to harden the alloy, and tempering treatment to toughen the alloy. It is believed that the alloying additions, for example, nickel, chromium, and molybdenum, tend to stabilize the austenite formed during the austenitizing heat treatment. The stabilization of austenite may tend to slow the transformation of the austenite to other microstructures during cooling from austenitizing temperatures. A decrease in the transformation rate of austenite may allow the formation of martensite using slower cooling rates that would otherwise tend to form microstructures rich in ferrite and cementite.

Thermal expansion measurements were conducted on an alloy having the experimental chemistry shown in Table 2 above. The thermal expansion measurements were conducted over a cooling range beginning at austenitizing temperatures (1450° F.-1650° F.) to approximately room temperature. The thermal expansion measurements revealed that at least one phase transition occurs in the alloy in the temperature range 300° F.-575° F. It is believed that the phase transition is from an austenite phase to a lower bainite phase, a lath martensite phase, or a combination of both lower bainite and lath martensite.

Generally, when an alloy having the experimental chemistry shown in Table 2 is cooled from austenitizing temperatures at a cooling rate above a threshold cooling rate (for example, in still air), the austenite phase transforms to a relatively hard twinned martensite phase and retained austenite. The retained austenite may transform to untempered twinned martensite over time. It is believed that tempering of the disclosed alloys at temperatures near the observable phase transition (e.g., tempering at a temperature in the range 250° F.-500° F.) may transform the retained austenite to lower bainite and/or lath martensite. Lower bainite and lath martensite microstructures are significantly more ductile and tougher than the significantly harder twinned martensite microstructure.

As a result, alloys according to various embodiments of the present disclosure may have a microstructure comprising twinned martensite, lath martensite, and/or lower bainite after tempering at a temperature in the range 250° F.-500° F. This may result in steel alloys having a synergistic combination of hard twinned martensite microstructure and tougher, more ductile lower bainite and/or lath martensite microstructure. A synergistic combination of hardness, toughness, and ductility may impart excellent ballistic penetration and crack resistance properties to the alloys as described herein.

In various embodiments, articles comprising an alloy as described herein may be heated at a temperature of 1450° F.-1650° F. to austenitize the alloy microstructure. In various embodiments, alloy articles may be heated for at least 15 minutes minimum furnace time, at least 18 minutes minimum furnace time, or at least 21 minutes minimum furnace time to austenitize the alloy. In various embodiments, alloy articles may be heated for 15-60 minutes or 15-30 minutes minimum furnace time to austenitize the alloy. For example, alloy plates having gauge thicknesses of 0.188-0.225 inches may be heated at a temperature of 1450° F.-1650° F. for at least 18 minutes minimum furnace time, and alloy plates having gauge thicknesses of 0.226-0.313 inches may be heated at a temperature of 1450° F.-1650° F. for at least 21 minutes minimum furnace time to austenitize the alloy. In various embodiments, alloy articles may be held at 1450° F.-1650° F. for 15-60 minutes or 15-30 minutes time-at-temperature to austenitize the alloys.

The alloy articles may be cooled from austenitizing temperature to room temperature in still air to harden the alloy. During cooling the alloy articles comprising sheets or plates may be flattened by the application of mechanical force to the article. For example, after the articles have cooled in still air to a surface temperature of 600° F. to 700° F., the plates may be flattened on a flattener/leveler apparatus. A flattening operation may include the application of mechanical force to the major planar surfaces of the articles. A mechanical force may be applied, for example, using a rolling operation, a stretching operation, and/or a pressing operation. The mechanical force is applied so that the gauge thicknesses of the articles are not decreased during the flattening operation. The articles are allowed to continue to cool during the flattening operation, which may be discontinued after the surface temperature of the articles falls below 250° F. The articles are not stacked together until the surface temperature of the cooling articles is below 200° F.

In various embodiments, alloy articles may be tempered at a temperature in the range 250° F. to 500° F. In various embodiments, an alloy article may be tempered at a temperature in the range 300° F. to 400° F. In various embodiments, an alloy article may be tempered at a temperature in the range 325° F. to 375° F., 235° F. to 350° F., or 335° F. to 350° F., for example. In various embodiments, an alloy article may be tempered for 450-650 minutes time-at-temperature. In various embodiments, an alloy article may be tempered for 480-600 minutes time-at-temperature. In various embodiments, an alloy article may be tempered for 450-500 minutes time-at-temperature.

In various embodiments, an alloy article processed as described herein may comprise an alloy sheet or an alloy plate. In various embodiments, an alloy article may comprise an alloy plate having an average thickness of 0.118-0.630 inches (3-16 mm). In various embodiments, an alloy article may comprise an alloy plate having an average thickness of 0.188-0.300 inches. In various embodiments, an alloy article may have a hardness greater than 550, BHN, 570 BHN, or 600 BHN. In various embodiments an alloy article may have a hardness less than 700 BHN or 675 BHN. In various embodiments, an alloy article may comprise a steel armor plate.

In various embodiments, an alloy article processed as described herein may exhibit a $V_{50}$ value that exceeds the minimum $V_{50}$ ballistic limit value per U.S. Military Specifications MIL-DTL-46100E and MIL-DTL-32332 (Class 1). In various embodiments, an alloy article processed as described herein may exhibit a $V_{50}$ value that exceeds the minimum $V_{50}$ ballistic limit value per specification MIL-DTL-46100E by at least 300, at least 350, at least 400, or at least 450 fps. In various embodiments, an alloy article processed as described herein may exhibit a $V_{50}$ value that exceeds the minimum $V_{50}$ ballistic limit value per specification MIL-DTL-32332 (Class 1) by at least 50, at least 100, or at least 150 fps. In various embodiments, an alloy article processed as described herein may exhibit low, minimal, or zero cracking or crack propagation resulting from multiple armor piecing projectile strikes.

In various embodiments, an alloy article processed as described herein may exhibit a $V_{50}$ value that exceeds the minimum $V_{50}$ ballistic limit value per specification MIL-A-46099C. In various embodiments, an alloy article processed as described herein may exhibit a $V_{50}$ value that is at least as great as a $V_{50}$ ballistic limit value that is 150 fps less than the performance requirements under specifications MIL-A-46099C and MIL-DTL-32332 (Class 2). In various embodiments, an alloy article processed as described herein may exhibit a $V_{50}$ value that is at least as great as a $V_{50}$ ballistic limit value that is 100 fps or 60 fps less than the performance requirements under MIL-A-46099C. In various embodiments, an alloy article processed as described herein may exhibit a $V_{50}$ value that is at least as great as a $V_{50}$ ballistic limit value that is 125 fps or 110 fps less than the performance requirements under MIL-DTL-32332 (Class 2). In various embodiments, an alloy article processed as described herein may exhibit low, minimal, or zero cracking or crack propagation resulting from multiple armor piecing projectile strikes.

In various embodiments, an alloy article processed as described herein may have a microstructure comprising at least one of lath martensite and lower bainite. In various embodiments, an alloy article processed as described herein may have a microstructure comprising lath martensite and lower bainite.

6. Processes for Making Armor Plate

The illustrative and non-limiting examples that follow are intended to further describe the various embodiments presented herein without restricting their scope. The Examples describe processes that may be utilized to make high hardness, high toughness, ballistic resistant, and crack resistant armor plates. Persons having ordinary skill in the art will appreciate that variations of the Examples are possible, for example, using different compositions, times, temperatures, and dimensions as variously described herein.

a. Example 1

A heat having the chemistry presented in Table 17 is prepared. Appropriate feed stock is melted in an electric arc furnace. The heat is tapped into a ladle where appropriate alloying additions are added to the melt. The heat is transferred in the ladle and poured into an AOD vessel. There the heat is decarburized using a conventional AOD operation. The decarburized heat is tapped into a ladle and poured into an ingot mold and allowed to solidify to form an ingot. The ingot is removed from the mold and may be transported to an ESR furnace where the ingot may be remelted and remolded to form a refined ingot. The ESR operation is optional and an ingot may be processed after solidification, post-AOD without ESR. The ingot has rectangular dimensions of 13×36 inches and a nominal weight of 4500 lbs.

TABLE 17

| C | Mn | P | S | Si | Cr | Ni | Mo | Ce | La | N | B |
|---|---|---|---|---|---|---|---|---|---|---|---|
| 0.50 | 0.50 | 0.009 | 0.0009 | 0.30 | 1.25 | 4.00 | 0.50 | 0.007 | 0.006 | 0.005 | 0.002 |

The ingot is heated in a furnace at 1300° F. for seven (7) hours (minimum furnace time), after which the ingot is heated at 200° F. per hour to 2050° F. and held at 2050° F. for 35 minutes per inch of ingot thickness (13 inches, 455 minutes). The ingot is de-scaled and hot rolled at 2050° F. on a 110-inch rolling mill to form a 6×36×length inch slab. The slab is reheated in a 2050° F. furnace for 1.5 hours minimum furnace time. The slab is hot rolled at 2050° F. on a 110-inch rolling mill to form a 2.65×36×length inch re-slab. The re-slab is hot sheared to form two (2) 2.65×36×54 inch re-slabs. The re-slabs are stress relief annealed in a furnace using conventional practices. The re-slabs are blast cleaned, all edges and ends are ground, and the re-slabs are heated to 1800° F. and held at 1800° F. for 20 minutes per inch of thickness (2.65 inches, 53 minutes).

The re-slabs are de-scaled and hot rolled at 1800° F. on a 110-inch rolling mill to form 0.313×54×300 inch plates. The re-slabs are re-heated to 1800° F. between passes on the rolling mill, as necessary, to avoiding finishing the rolling operation below 1425° F.

The 0.313×54×300 inch plates are heated in a furnace for 21 minutes at 1625° F. (minimum furnace time) to austenitize the plates. The furnace is pre-heated to 1625° F. and the plates inserted for 21 minutes after the temperature stabilizes at 1625° F. It is believed that the plate reaches a temperature of 1600-1625° F. during the 21 minute minimum furnace time.

After completion of the 21 minute minimum furnace time, the austenitized plates are removed from the furnace and allowed to cool to 1000° F. in still air. After the plates have cooled to 1000° F., the plates are transported via an overhead crane to a Cauffiel™ flattener. After the plates have reached 600° F.-700° F., the plates are flattened on the flattener by applying mechanical force to the 54×300 inch planar surfaces of the plates. The mechanical force is applied so that the gauge thicknesses of the plates are not decreased during the flattening operation. The plates are allowed to continue to cool during the flattening operation, which is discontinued after the temperature of the plates falls below 250° F. The plates are not stacked until the temperature of the cooling plates is below 200° F.

The cooled plates are blast cleaned and sectioned to various length-by-width dimensions using an abrasive saw cutting operation. The sectioned plates are heated to 335° F. (±5° F.) in a furnace, held for 480-600 minutes (±5 minutes) at 335° F. (±5° F.) (time-at-temperature) to temper the plates, and allowed to cool to room temperature in still air. The tempered plates exhibit a hardness of at least 550 BHN.

The tempered plates find utility as armor plates exhibiting high hardness, high toughness, excellent ballistic resistance, and excellent crack resistance. The tempered plates exhibit a $V_{50}$ ballistic limit value greater than the minimum $V_{50}$ ballistic limit value under specification MIL-DTL-32332 (Class 1). The tempered plates also exhibit a $V_{50}$ ballistic limit value that is at least as great as a $V_{50}$ ballistic limit value 150 feet per second less than the required $V_{50}$ ballistic limit value under specification MIL-DTL-32332 (Class 2).

b. Example 2

A heat having the chemistry present in Table 18 is prepared. Appropriate feed stock is melted in an electric arc furnace. The heat is tapped into a ladle where appropriate alloying additions are added to the melt. The heat is transferred in the ladle and poured into an AOD vessel. There the heat is decarburized using a conventional AOD operation. The decarburized heat is tapped into a ladle and poured into an ingot mold and allowed to solidify to form an ingot. The ingot is removed from the mold and may be transported to an ESR furnace where the ingot may be remelted and remolded to form a refined ingot. The ESR operation is optional and an ingot may be processed after solidification, post-AOD without ESR. The ingot has rectangular dimensions of 13×36 inches and a nominal weight of 4500 lbs.

TABLE 18

| C | Mn | P | S | Si | Cr | Ni | Mo | Ce | La | N | B |
|---|---|---|---|---|---|---|---|---|---|---|---|
| 0.49 | 0.20 | 0.009 | 0.0009 | 0.20 | 1.00 | 3.75 | 0.40 | 0.003 | 0.002 | 0.005 | 0.001 |

The ingot is heated in a furnace at 1300° F. for six (6) hours (minimum furnace time), after which the ingot is heated at 200° F. per hour to 2050° F. and held at 2050° F. for 30 minutes per inch of ingot thickness (13 inches, 390 minutes). The ingot is de-scaled and hot rolled at 2050° F. on a 110-inch rolling mill to form a 6×36×length inch slab. The slab is reheated in a 2050° F. furnace for 1.5 hours. The slab is hot rolled at 2050° F. on a 110-inch rolling mill to form a 1.75×36×length inch re-slab. The re-slab is hot sheared to form two (2) 1.75×36×38 inch re-slabs. The re-slabs are stress relief annealed in a furnace using conventional practices. The re-slabs are blast cleaned, all edges and ends are ground, and the re-slabs are heated at 1800° F. for 20 minutes per inch of thickness (1.75 inches, 35 minutes).

The re-slabs are de-scaled and hot rolled at 1800° F. on a 110-inch rolling mill to form 0.188×54×222 inch plates. The re-slabs are re-heated to 1800° F. between passes on the rolling mill, as necessary, to avoiding finishing the rolling operation below 1425° F.

The 0.188×54×222 inch plates are heated in a furnace at 1600° F. for 18 minutes (minimum furnace time) to austenitize the plates. The furnace is pre-heated to 1600° F. and the plates inserted for 18 minutes after the temperature stabilizes at 1600° F. It is believed that the plate reaches a temperature of 1575-1600° F. during the 18 minute minimum furnace time.

After completion of the 18 minute minimum furnace time, the austenitized plates are removed from the furnace and allowed to cool to 1000° F. in still air. After the plates have cooled to 1000° F., the plates are transported via an overhead crane to a Cauffiel™ flattener. After the plates have reached 600° F.-700° F., the plates are flattened on the flattener by applying mechanical force to the 54×222 inch planar surfaces of the plates. The mechanical force is applied so that the gauge thicknesses of the plates are not decreased during the flattening operation. The plates are allowed to continue to cool during the flattening operation, which is discontinued after the temperature of the plates falls below 250° F. The plates are not stacked until the temperature of the cooling plates is below 200° F.

The cooled plates are blast cleaned and sectioned to various length-by-width dimensions using an abrasive saw cutting operation. The sectioned plates are heated to 325° F. (±5° F.) in a furnace, held for 480-600 minutes (±5 minutes) at 325° F. (±5° F.) (time-at-temperature) to temper the plates, and allowed to cool to room temperature in still air. The tempered plates exhibit a hardness of at least 550 BHN.

The tempered plates find utility as armor plates having high hardness, high toughness, excellent ballistic resistance, and excellent crack resistance. The tempered plates exhibit a $V_{50}$ ballistic limit value greater than the minimum $V_{50}$ ballistic limit value under specification MIL-DTL-32332 (Class 1). The tempered plates also exhibit a $V_{50}$ ballistic limit value that is at least as great as a $V_{50}$ ballistic limit value 150 feet per second less than the required $V_{50}$ ballistic limit value under specification MIL-DTL-32332 (Class 2).

c. Example 3

A heat having the chemistry present in Table 19 is prepared. Appropriate feed stock is melted in an electric arc furnace. The heat is tapped into a ladle where appropriate alloying additions are added to the melt. The heat is transferred in the ladle and poured into an AOD vessel. There the heat is decarburized using a conventional AOD operation. The decarburized heat is tapped into a ladle and poured into an ingot mold and allowed to solidify to form an ingot. The ingot is removed from the mold and may be transported to an ESR furnace where the ingot may be remelted and remolded to form a refined ingot. The ESR operation is optional and an ingot may be processed after solidification, post-AOD without ESR. The ingot has rectangular dimensions of 13×36 inches and a nominal weight of 4500 lbs.

TABLE 19

| C | Mn | P | S | Si | Cr | Ni | Mo | Ce | La | N | B |
|---|---|---|---|---|---|---|---|---|---|---|---|
| 0.51 | 0.80 | 0.010 | 0.001 | 0.40 | 1.50 | 4.25 | 0.60 | 0.01 | 0.01 | 0.007 | 0.003 |

The ingot is heated in a furnace at 1300° F. for eight (8) hours (minimum furnace time), after which the ingot is heated at 200° F. per hour to 2050° F. and held at 2050° F. for 40 minutes per inch of ingot thickness (13 inches, 520 minutes). The ingot is de-scaled and hot rolled at 2050° F. on a 110-inch rolling mill to form a 6×36×length inch slab. The slab is reheated in a 2050° F. furnace for 1.5 hours. The slab is hot rolled at 2050° F. on a 110-inch rolling mill to form a 1.75×36×length inch re-slab. The re-slab is hot sheared to form two (2) 1.75×36×50 inch re-slabs. The re-slabs are stress relief annealed in a furnace using conventional practices. The re-slabs are blast cleaned, all edges and ends are ground, and the re-slabs are heated to 1800° F. and held at 1800° F. for 20 minutes per inch of thickness (1.75 inches, 35 minutes).

The re-slabs are de-scaled and hot rolled at 1800° F. on a 110-inch rolling mill to form 0.250×54×222 inch plates. The re-slabs are re-heated to 1800° F. between passes on the rolling mill, as necessary, to avoiding finishing the rolling operation below 1425° F.

The 0.250×54×222 inch plates are heated in a furnace for 21 minutes at 1625° F. (minimum furnace time) to austenitize the plates. The furnace is pre-heated to 1625° F. and the plates inserted for 21 minutes after the temperature stabilizes at 1625° F. It is believed that the plate reaches a temperature of 1600-1625° F. during the 21 minute minimum furnace time.

After completion of the 21 minute minimum furnace time, the austenitized plates are removed from the furnace and allowed to cool to 1000° F. in still air. After the plates have cooled to 1000° F., the plates are transported via over head crane to a Cauffiel™ flattener. After the plates have reached 600° F.-700° F., the plates are flattened on the flattener by applying mechanical force to the 54×222 inch planar surfaces of the plates. The mechanical force is applied so that the gauge thicknesses of the plates are not decreased during the flattening operation. The plates are allowed to continue to cool during the flattening operation, which is discontinued after the temperature of the plates falls below 250° F. The plates are not stacked until the temperature of the cooling plates is below 200° F.

The cooled plates are blast cleaned and sectioned to various length-by-width dimensions using an abrasive saw cutting operation. The sectioned plates are heated to 350° F. (±5° F.) in a furnace, held for 480-600 minutes (±5 minutes) at 350° F. (±5° F.) (time-at-temperature) to temper the plates, and allowed to cool to room temperature in still air. The tempered plates exhibit a hardness of at least 550 BHN.

The tempered plates find utility as armor plates having high hardness, high toughness, excellent ballistic resistance, and excellent crack resistance. The tempered plates exhibit a $V_{50}$ ballistic limit value greater than the minimum $V_{50}$ ballistic limit value under specification MIL-DTL-32332 (Class 1). The tempered plates also exhibit a $V_{50}$ ballistic limit value that is at least as great as a $V_{50}$ ballistic limit value 150 feet per second less than the required $V_{50}$ ballistic limit value under specification MIL-DTL-32332 (Class 2).

d. Example 4

A heat having the chemistry present in Table 20 is prepared. Appropriate feed stock is melted in an electric arc furnace. The heat is tapped into a ladle where appropriate alloying additions are added to the melt. The heat is transferred in the ladle and poured into an AOD vessel. There the heat is decarburized using a conventional AOD operation. The decarburized heat is tapped into a ladle and poured into an ingot mold and allowed to solidify to form an 8×38×115 inch ingot. The ingot is removed from the mold and transported to an ESR furnace where the ingot is remelted and remolded to form a refined ingot. The refined ingot has rectangular dimensions of 12×42 inches and a nominal weight of 9500 lbs.

TABLE 20

| C | Mn | P | S | Si | Cr | Ni | Mo | Ce | La | N | B |
|---|---|---|---|---|---|---|---|---|---|---|---|
| 0.50 | 0.50 | 0.009 | 0.0009 | 0.30 | 1.25 | 4.00 | 0.50 | 0.007 | 0.006 | 0.005 | 0.002 |

The 12×42 inch refined ingot is converted to a 2.7×42×63 inch slab. The slab is heated in a furnace at 1800° F. for one (1) hour (minimum furnace time), after which the slab is held at 1800° F. for an additional 20 minutes per inch of ingot thickness (2.7 inches, 54 additional minutes)). The slab is de-scaled and hot rolled at 1800° F. on a 110-inch rolling mill to form a 1.5×42×length inch re-slab. The re-slab is hot sheared to form two (2) 1.5×42×48 inch re-slabs. The re-slabs are stress relief annealed in a furnace using conventional practices. The re-slabs are blast cleaned, all edges and ends are ground, and the re-slabs are heated at 1800° F. for 20 minutes per inch of thickness (1.5 inches, 30 minutes).

The re-slabs are de-scaled and hot rolled at 1800° F. on a 110-inch rolling mill to form 0.238×54×222 inch plates. The re-slabs are re-heated between passes on the rolling mill to 1800° F., as necessary, to avoiding finishing the rolling operation below 1425° F.

The 0.238×54×222 inch plates are heated in a furnace for 21 minutes at 1625° F. (minimum furnace time) to austenitize the plates. The furnace is pre-heated to 1625° F. and the plates inserted for 21 minutes after the temperature stabilizes at 1625° F. It is believed that the plate reaches a temperature of 1600-1625° F. during the 21 minute minimum furnace time.

After completion of the 21 minute minimum furnace time, the austenitized plates are removed from the furnace and allowed to cool to 1000° F. in still air. After the plates have cooled to 1000° F., the plates are transported via overhead crane to a Cauffiel™ flattener. After the plates have reached 600° F.-700° F., the plates are flattened on the flattener by applying mechanical force to the 54×222 inch planar surfaces of the plates. The mechanical force is applied so that the gauge thicknesses of the plates are not decreased during the flattening operation. The plates are allowed to continue to cool during the flattening operation, which is discontinued after the temperature of the plates falls below 250° F. The plates are not stacked until the temperature of the cooling plates is below 200° F.

The cooled plates are blast cleaned and sectioned to various length-by-width dimensions using an abrasive saw cutting operation. The sectioned plates are heated to 335° F. (±5° F.) in a furnace, held for 480-600 minutes (±5 minutes) at 335° F. (±5° F.) (time-at-temperature) to temper the plates, and allowed to cool to room temperature in still air. The tempered plates exhibit a hardness of at least 550 BHN.

The tempered plates find utility as armor plates having high hardness, high toughness, excellent ballistic resistance, and excellent crack resistance. The tempered plates exhibit a $V_{50}$ ballistic limit value greater than the minimum $V_{50}$ ballistic limit value under specification MIL-DTL-32332 (Class 1). The tempered plates also exhibit a $V_{50}$ ballistic limit value that is at least as great as a $V_{50}$ ballistic limit value 150 feet per second less than the required $V_{50}$ ballistic limit value under specification MIL-DTL-32332 (Class 2).

Steel armors according to the present disclosure may provide substantial value because they exhibit ballistic performance at least commensurate with premium, high alloy armor alloys, while including substantially lower levels of costly alloying ingredients such as, for example, nickel, molybdenum, and chromium. Further, steel armors according the present disclosure exhibit ballistic performance at least commensurate with the U.S. Military Specification requirements for dual hardness, roll-bonded material, such as, for example, the requirements under described in MIL-A-46099C. Given the performance and cost advantages of embodiments of steel armors according to the present disclosure, it is believed that such armors are a very substantial advance over many existing armor alloys.

The alloy plate and other mill products made according to the present disclosure may be used in conventional armor applications. Such applications include, for example, armored sheathing and other components for combat vehicles, armaments, armored doors and enclosures, and other article of manufacture requiring or benefiting from protection from projectile strikes, explosive blasts, and other high energy insults. These examples of possible applications for alloys according to the present disclosure are offered by way of example only, and are not exhaustive of all applications to which the present alloys may be applied. Those having ordinary skill, upon reading the present disclosure, will readily identify additional applications for the alloys described herein. It is believed that those having ordinary skill in the art will be capable of fabricating all such articles of manufacture from alloys according to the present disclosure based on knowledge existing within the art. Accordingly, further discussion of fabrication procedures for such articles of manufacture is unnecessary here.

The present disclosure has been written with reference to various exemplary, illustrative, and non-limiting embodiments. However, it will be recognized by persons having ordinary skill in the art that various substitutions, modifications, or combinations of any of the disclosed embodiments (or portions thereof) may be made without departing from the scope of the invention as defined solely by the claims. Thus, it is contemplated and understood that the present disclosure embraces additional embodiments not expressly set forth herein. Such embodiments may be obtained, for example, by combining, modifying, or reorganizing any of the disclosed steps, ingredients, constituents, components, elements, features, aspects, and the like, of the embodiments described herein. Thus, this disclosure is not limited by the description of the various exemplary, illustrative, and non-limiting embodiments, but rather solely by the claims. In this manner, Applicants reserve the right to amend the claims during prosecution to add features as variously described herein.

What is claimed is:

1. A process for making an alloy article comprising:

austenitizing an alloy article by heating the alloy article in a furnace operating at a temperature of at least 1450° F., the alloy article comprising, in weight percentages based on total alloy weight:

0.40 to 0.53 carbon;
0.15 to 1.00 manganese;
0.15 to 0.45 silicon;
1.00 to 1.50 chromium;
3.75 to 4.25 nickel;
0.40 to 0.60 molybdenum; and
iron;

cooling the alloy article from the austenitizing temperature in still air; and tempering the alloy article at 250° F. to 500° F. for 450 minutes to 650 minutes time-at-temperature to provide a tempered alloy article exhibiting a microstructure comprising at least one of lath martensite phase and lower bainite phase;

wherein the process does not comprise a liquid quench between the cooling and the tempering.

2. The process of claim 1, wherein the tempering comprises tempering the alloy article at 325° F. to 350° F. for 480 minutes to 600 minutes time-at-temperature.

3. The process of claim 1, wherein the tempered alloy article exhibits a hardness greater than 570 BHN and less than 675 BHN.

4. The process of claim 1, wherein the tempered alloy article exhibits a hardness greater than 600 BHN and less than 675 BHN.

5. The process of claim 1, wherein the tempered alloy article comprises a plate having a thickness in the range of 0.188-0.300 inches.

6. The process of claim 1, wherein the tempered alloy article comprises one of an armor plate and an armor sheet.

7. The process of claim 1, wherein the tempered alloy article exhibits a $V_{50}$ ballistic limit value that exceeds the minimum $V_{50}$ ballistic limit value under specification MIL-DTL-32332 (Class 1) by at least 50 feet per second.

8. The process of claim 1, wherein the tempered alloy article exhibits a $V_{50}$ ballistic limit value that is at least as great as a $V_{50}$ ballistic limit 100 feet per second less than the required $V_{50}$ ballistic limit under specification MIL-DTL-32332 (Class 2).

9. The process of claim 1, wherein the tempered alloy article exhibits zero observable cracking when subjected to a .30 caliber M2, AP projectile strike.

10. The process of claim 1, wherein the alloy article comprises, in weight percentages based on total alloy weight:

0.40 to 0.53 carbon;
0.15 to 1.00 manganese;
0.15 to 0.45 silicon;
1.00 to 1.50 chromium;
3.75 to 4.25 nickel;
0.40 to 0.60 molybdenum;
0.0002 to 0.0050 boron;
0.001 to 0.015 cerium;
0.001 to 0.015 lanthanum;
no greater than 0.002 sulfur;
no greater than 0.015 phosphorus;
no greater than 0.011 nitrogen;
iron; and
incidental impurities.

* * * * *